US011316306B2

(12) United States Patent
Chen

(10) Patent No.: US 11,316,306 B2
(45) Date of Patent: Apr. 26, 2022

(54) ELECTRICAL CONNECTOR

(71) Applicant: LOTES CO., LTD, Keelung (TW)

(72) Inventor: Xue Rong Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 10 days.

(21) Appl. No.: 17/128,681

(22) Filed: Dec. 21, 2020

(65) Prior Publication Data

US 2021/0203104 A1 Jul. 1, 2021

(30) Foreign Application Priority Data

Dec. 25, 2019 (CN) ..... 201911351494.7

(51) Int. Cl.
*H01R 13/6471* (2011.01)
*H01R 12/72* (2011.01)
(Continued)

(52) U.S. Cl.
CPC ..... *H01R 13/6471* (2013.01); *H01R 12/721* (2013.01); *H01R 13/405* (2013.01);
(Continued)

(58) Field of Classification Search
CPC ..... H01R 12/721; H01R 13/6471; H01R 13/6594; H01R 13/6595; H01R 13/405; H01R 13/502; H01R 13/518
(Continued)

(56) References Cited

U.S. PATENT DOCUMENTS 5,800,213 A * 9/1998 Regnier ..... H01R 12/721 439/733.1
5,810,623 A * 9/1998 Regnier ..... H01R 12/721 439/885
(Continued)

FOREIGN PATENT DOCUMENTS

CN 103594871 A * 2/2014
CN 108448287 A * 8/2018 ..... H01R 12/70
(Continued)

*Primary Examiner* — Peter G Leigh
(74) *Attorney, Agent, or Firm* — Locke Lord LLP; Tim Tingkang Xia, Esq.

(57) ABSTRACT

An electrical connector is used to electrically connect a first component and a second component, including: an insulating body, having an insertion slot for the first component to insert backward therein; multiple terminals, having at least one pair of first signal terminals. Each terminal has a contact portion and a tail portion provided in the front-rear direction. The contact portion is provided relatively in front of the bottom surface and protrudes into the insertion slot to be electrically connected to the first component. The tail portion is electrically connected to the second component. Each terminal further has a connecting portion located between the contact portion and the tail portion. An insulating block is used to fix the terminal. The connecting portion of each terminal extends forward from the front surface of the insulating block and passes beyond the bottom surface. A portion of the connecting portion of each terminals not passing forward beyond the bottom surface is defined as an adjusting portion. A medium between the two adjusting
(Continued)

portions of each pair of first signal terminals is completely a first medium. A dielectric coefficient of the first medium is less than a dielectric coefficient of the insulating body.

20 Claims, 17 Drawing Sheets

(51) Int. Cl.
*H01R 13/405* (2006.01)
*H01R 13/502* (2006.01)
*H01R 13/518* (2006.01)
*H01R 13/6594* (2011.01)
*H01R 13/6597* (2011.01)

(52) U.S. Cl.
CPC ..... *H01R 13/502* (2013.01); *H01R 13/518* (2013.01); *H01R 13/6594* (2013.01); *H01R 13/6597* (2013.01)

(58) Field of Classification Search
USPC ..... 439/108
See application file for complete search history.

(56) References Cited

U.S. PATENT DOCUMENTS 6,315,615 B1 * 11/2001 Raistrick ..... H01R 12/585 439/733.1
8,961,199 B2 * 2/2015 Tai ..... H01R 12/724 439/79
9,525,241 B1 * 12/2016 Su ..... H01R 13/62
9,627,817 B2 * 4/2017 Chang ..... H01R 13/6594
10,103,501 B2 * 10/2018 Lin ..... H01R 13/6596
10,153,596 B2 * 12/2018 Lin ..... H01R 13/6582
10,446,986 B2 * 10/2019 Zhong ..... H01R 13/6593
10,490,920 B2 * 11/2019 Manickam ..... H01R 13/648
2012/0094542 A1 * 4/2012 Duenas ..... H01R 13/6471 439/630
2014/0370759 A1 * 12/2014 Tai ..... H01R 12/724 439/629
2017/0352970 A1 * 12/2017 Liang ..... H01R 12/7052
2019/0190212 A1 * 6/2019 Fang ..... H01R 13/6597
2019/0372274 A1 * 12/2019 Feng ..... H01R 13/46

FOREIGN PATENT DOCUMENTS

CN 108832339 A * 11/2018 ..... H01R 12/721
CN 109193193 A * 1/2019 ..... H01R 12/716
CN 109193203 A * 1/2019 ..... H01R 12/724
CN 208797211 U * 4/2019 ..... H01R 12/721
CN 208797211 U 4/2019
CN 109980400 A 7/2019
CN 209658537 U * 11/2019
JP 4607425 B2 * 1/2011 ..... H01R 13/502
TW 569510 U * 11/2018 ..... H01R 13/6581

* cited by examiner

M

A-A

B-B

C–C

D-D

E-E

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911351494.7 filed in China on Dec. 25, 2019. The disclosure of the above application is incorporated herein in its entirety by reference.

FIELD

The present invention relates to an electrical connector, and particularly to an electrical connector having good signal transmission efficiency.

BACKGROUND

A conventional electrical connector is shown in Chinese Patent No. CN201711462429.2. The patent discloses that the electrical connector mainly includes an insulating body, a row of first terminals, and a row of second terminals. The insulating body includes an insertion slot used to accommodate a mating member, a first fixing body fixing the first terminals, and a second fixing body fixing the second terminals. A front surface of the first fixing body and a front surface of the second fixing body altogether form a bottom surface of the insertion slot.

Each first terminal includes a first fixing portion fixing the first fixing body, a first elastic arm portion extending from a front surface of the first fixing portion and a first contact portion extending forward from the first elastic arm portion. The first elastic arm portion and the first contact portion are provided at one side of the insertion slot, and the first contact portion and the mating member form electrical connection, thereby facilitating signal transmission. The row of the first terminals has a plurality of first ground terminals and a plurality of first signal terminals. A pair of the first signal terminals are provided between two adjacent ones of the first ground terminals. One side of the insertion slot has a plurality of first insulating separation ribs, provided between the first elastic arm portion of each first ground terminal and the first elastic arm portion of its adjacent first signal terminal, thus separation the first elastic arm portion of each first ground terminal and the first elastic arm portion of its adjacent first signal terminal. There is no first insulating separation rib separating the two first elastic arm portions between a pair of the first signal terminals, thereby suppressing the resonance of the electrical connector.

Further, in the process of the signals transmitting in the first signal terminals, the impedance in the first fixing portion is higher than the impedance of the first elastic arm portion, and the signals will attenuate due to the increase of the impedance. Thus, to ensure the signal output efficiency of the electrical connector, and to reduce the attenuation of the signals in the transmission path, stability of signal transmission and speed of signal transmission of the back end of the first elastic arm portion must be ensured. However, so after the mating member is inserted into the mating slot, the signal conductors of the mating member and the first signal terminals facilitate signal transmission. In the electrical connector disclosed in Chinese Patent No. CN201711462429.2, the back end of the first elastic arm portion is close to the front relative to the bottom surface of the insertion slot, such that the interference electromagnetic wave of the signal conductors of the mating member will affect the signal transmission of the back end of the first elastic arm portion, thereby affecting the signal transmission efficiency, which is not conducive to the characteristics of the electrical connector.

Therefore, a heretofore unaddressed need to design a novel electrical connector exists in the art to address the aforementioned deficiencies and inadequacies.

SUMMARY

The objective of the present invention is to provide an electrical connector, where the adjusting portion of each terminal located in front of the fixing portion of each terminal is provided behind a bottom surface of the insertion slot, thereby reducing the signal interference electromagnetic wave effect, and enhancing signal transmission efficiency.

To achieve the foregoing objective, the present invention adopts the following technical solutions.

An electrical connector is configured to electrically connect a first component and a second component. The electrical connector includes: an insulating body, having an insertion slot concavely provided backward and configured for the first component to insert backward therein along a front-rear direction, wherein a bottom surface is defined behind the insertion slot, the insulating body has a plurality of side walls connected to the bottom surface, the side walls surroundingly form the insertion slot, one of the side walls is defined as a first side wall, the first side wall has a first side surface facing the insertion slot, and the first side wall has a first rib extending backward and having a free end; a plurality of terminals, having at least one pair of first signal terminals provided at one side of the insertion slot, wherein each of the terminals has a contact portion and a tail portion provided in the front-rear direction, the contact portion is provided relatively in front of the bottom surface and protrudes into the insertion slot to be electrically connected to the first component, the tail portion is electrically connected to the second component, each of the terminals further has a fixing portion and a connecting portion, the fixing portion and the connecting portion are located between the contact portion and the tail portion, the connecting portion is relatively close to the contact portion, and the fixing portion is relatively close to the tail portion; wherein a first direction is defined to be perpendicular to the front-rear direction, the at least one pair of first signal terminals are arranged along the first direction and provided on the first side wall, the free end of the first rib is located between the two contact portions of one of the at least one pair of first signal terminals, and a portion of each of the contact portions of the terminals provided on the first side wall protrudes inward relative to the first side surface into the insertion slot to be electrically connected to the first component; wherein prior to the first component inserting into the insertion slot, a projection of the portion of each of the contact portions protruding inward relative to the first side surface along the first direction and a projection of the first side surface along the first direction virtually form a front intersection line and a rear intersection line provided at intervals along the front-rear direction, and the free end of the first rib passes backward beyond the front intersection line and does not pass backward beyond the rear intersection line; and an insulating block, wherein a front surface of the insulating block is provided relatively behind the bottom surface, the fixing portion of each of the terminals is fixed to the insulating block, the connecting portion of each of the terminals extends forward from the front surface of the insulating block and passes beyond the bottom surface, a portion of the connecting portion of each of the terminals not passing forward beyond the bottom surface is defined as an adjusting portion, a medium between the two adjusting portions of each of the at least one pair of first signal terminals is completely a first medium, and a dielectric coefficient of the first medium is less than a dielectric coefficient of the insulating body.

Further, the first side wall has a plurality of first separation walls, and each of the first separation walls continuously extends backward from a front thereof and passes backward beyond the bottom surface; a row of the terminals are provided on the first side wall and comprise one pair of the first signal terminals and a first ground terminal provided adjacently along the first direction; and one of the first separation walls exists between the adjusting portion of the first ground terminal and the adjusting portion of an adjacent one of the first signal terminals, and none of the first separation walls exists between the adjusting portions of the one pair of the first signal terminals.

Further, each of the first separation walls defines a first width in the first direction, a distance between the adjusting portions of the one pair of the first signal terminals in the first direction is defined as a first distance, a distance between the adjusting portion of the first ground terminal and the adjusting portion of the adjacent one of the first signal terminals in the first direction is defined as a second distance, the first distance is less than the first width, and the first width is less than the second distance; a distance between the connecting portion of the first ground terminal and the connecting portion of the adjacent one of the first signal terminals is provided to be unequal backward from a front thereof and is separated by the one of the first separation walls, and a distance between the two connecting portions of the one pair of the first signal terminals is equal to the first distance backward from a front thereof and is not separated by any of the first separation walls.

Further, a second direction is defined to be perpendicular to the first direction and the front-rear direction; the side walls has a second side wall, the second side wall and the first side wall face each other along the second direction, the insertion slot is located between the first side wall and the second side wall, the second side wall has a plurality of second separation walls, each of the second separation walls continuously extends backward from a front thereof and passes backward beyond the bottom surface; another row of the terminals are provided on the second side wall and comprise one pair of second signal terminals and a second ground terminal provided adjacently along the first direction; and one of the second separation walls exists between the adjusting portion of the second ground terminal and the adjusting portion of an adjacent one of the second signal terminals, and none of the second separation walls exists between the adjusting portions of the one pair of the second signal terminals.

Further, the fixing portion of each of the terminals has a cushion portion connected forward to the adjusting portion; the insulating block has a first hole, and the cushion portions of one pair of the first signal terminals are exposed in the first hole; and the insulating body has a first air slot, the first air slot is communicated with a side of the first hole, and the first air slot and the two cushion portions of the one pair of the first signal terminals pass through a same vertical plane.

Further, two sides of the first hole in the first direction are provided to be outer relative to two sides of the first air slot in the first direction.

Further, the terminals comprise one pair of the first signal terminals and a first ground terminal provided on the first side wall and provided adjacently along the first direction, the fixing portion of each of the terminals has a cushion portion connected forward to the adjusting portion; the insulating block has a second hole, and the cushion portion of the first ground terminal is exposed in the second hole; and the insulating body has a second air slot, the second air slot is communicated with a side of the second hole, and the second air slot and the cushion portion of the first ground terminal pass through a same vertical plane.

Further, the terminals further comprise at least one first ground terminal, one of the at least one pair of first signal terminals and the at least one first ground terminal are provided adjacently along the first direction and arranged in a row, and a size of each of the terminals along the first direction is defined as a width; and a width of the adjusting portion of each of the first signal terminals is greater than a width of the adjusting portion of the first ground terminal, and a width of the fixing portion of each of the first signal terminals is less than a width of the fixing portion of the first ground terminal.

Further, each of two side edges of the contact portion of each of the terminals respectively has a guiding corner, and the guiding corners of one pair of the first signal terminals guide the contact portions to partially pass the corresponding first rib and to protrude into the insertion slot.

Further, the first side wall has a plurality of first windows, each of the first windows penetrates through an outer surface of the first side wall, prior to the first component being inserted into the insertion slot, each of the first windows correspondingly exposes one pair of the contact portions of a corresponding pair of the first signal terminals and the corresponding first rib, and when the first component is inserted into the insertion slot, each of the first windows exposes outward a process of the one pair of the contact portions of the corresponding pair of the first signal terminals on both sides of the corresponding first rib moving outward.

To achieve the foregoing objective, the present invention adopts another technical solution as follows.

An electrical connector is configured to electrically connect a first component and a second component. The electrical connector includes: an insulating body, having an insertion slot concavely provided backward and configured for the first component to insert backward therein along a front-rear direction, wherein a bottom surface is defined behind the insertion slot, the insulating body has a plurality of side walls surroundingly forming the insertion slot and connected to the bottom surface, one of the side walls is defined as a first side wall, the first side wall has a plurality of first separation walls, and each of the first separation walls continuously extends backward from a front thereof and passes backward beyond the bottom surface; and a plurality of terminals arranged in a row along a first direction, wherein the first direction is perpendicular to the front-rear direction, the row of the terminals are provided on the first side wall and have at least one pair of first signal terminals and at least one first ground terminal, at least one adjacent side of one of the at least one pair of first signal terminals is provided with one of the at least one first ground terminal, each of the terminals has an elastic portion extending along the front-rear direction and being free, a front end of the elastic portion is provided on the bottom surface close to front thereof and protrudes into the insertion slot to elastically abut and be electrically connected to the first component, a back end of the elastic portion has an adjusting portion, and the adjusting portion is provided to be behind relative to the bottom surface; wherein one of the first separation walls is located between one of the first signal terminals and an adjacent one of the at least one first ground terminal, the one of the first separation walls continuously separates the two corresponding elastic portions thereof backward from a front thereof, none of the first separation walls exists between one of the at least one pair of first signal terminals, the two adjusting portions of the one of the at least one pair of first signal terminals are separated only by a first medium, and a dielectric coefficient of the first medium is less than a dielectric coefficient of each of the first separation walls; wherein the first side wall has a first rib extending backward and having a free end, and the free end of the first rib is located between the one of the at least one pair of first signal terminals; and wherein the front end of the elastic portion of each of the first signal terminals has a contact portion arched toward the insertion slot, a portion of the contact portion protrudes inward into the insertion slot to elastically abut and be electrically connected to the first component, a back end of the contact portion has a transition portion, the transition portion is connected backward to a connecting portion, two opposite inner edges of two adjacent ones of the transition portions of the first signal terminals form a trumpet shape shrinking backward from a front thereof, and the first rib extends backward and does not pass beyond the transition portion.

Further, each of two side edges of the contact portion of each of the first signal terminals respectively has a guiding corner, and the guiding corners of one pair of the first signal terminals guide the contact portions to partially pass the corresponding first rib and to protrude into the insertion slot.

Further, an inward-outward direction is defined, a portion of the elastic portion protrudes inward into the insertion slot, and after abutting the first component, the elastic portion elastically deforms outward; and the first side wall has at least one window, one of the at least one window correspondingly exposes outward portions of a pair of the elastic portions of one of the at least one pair of first signal terminals.

Further, each of the terminals has a fixing portion, and the fixing portion has a cushion portion connected forward to the adjusting portion; the electrical connector further has an insulating block, the insulating block is provided behind the insertion slot, and the fixing portion is fixed to the insulating block; an accommodating space and a protruding block are backward provided on a front surface of the insulating block, an inner side surface of the protruding block forms a side wall of the accommodating space, the cushion portion of each of the terminals is embedded in the protruding block, and the adjusting portion of each of the terminals extends forward from a front surface of the protruding block; and a back end of each of the first separation walls has a first portion extending backward into the accommodating space, each two adjacent ones of the first portions of the first separation walls and the inner side surface of the protruding block altogether form an air slot, inner sides of one of the at least one pair of first signal terminals are provided with one air slot, defined as a first air slot, an inner side of one of the at least one first ground terminal is provided with another air slot, defined as a second air slot, and a size of the first air slot in the first direction is greater than a size of the second air slot in the first direction.

Further, the protruding block has a first hole concavely provided from the inner side surface of the protruding block, the first hole is communicated with the first air slot and exposes the cushion portions of one of the at least one pair of first signal terminals, and two sides of the first hole in the first direction are provided to be outer relative to two sides of the first air slot in the first direction.

Further, each of the terminals has a fixing portion not freely provided, the elastic portion is formed by extending forward from the fixing portion, a size of each of the terminals along the first direction is defined as a width, a width of the adjusting portion of each of the first signal terminals is greater than a width of the adjusting portion of the adjacent first ground terminal, and a width of the fixing portion of each of the first signal terminals is less than a width of the fixing portion of the first ground terminal.

To achieve the foregoing objective, the present invention adopts another technical solution as follows.

An electrical connector is configured to electrically connect a first component and a second component. The electrical connector includes: an insulating body, having an insertion slot concavely provided backward and configured for the first component to insert backward therein along a front-rear direction, wherein a bottom surface is defined behind the insertion slot, the insulating body has a plurality of side walls connected to the bottom surface, the side walls surroundingly form the insertion slot, one of the side walls is defined as a first side wall, the first side wall has a plurality of first ribs extending backward and a plurality of first separation walls extending backward, each of the first ribs has a free end located in front of the bottom surface, and each of the first separation walls continuously extends backward from a front thereof and passes backward beyond the bottom surface; a plurality of terminals, comprising a plurality of pairs of first signal terminals and a plurality of first ground terminals arranged on the first side wall along a left-right direction, wherein each pair of the pairs of the first signal terminals is configured to transmit differential signals, each of a left side and a right side of each pair of the pairs of the first signal terminals is provided with an adjacent one of the first ground terminals, each of the terminals has a fixing portion, a contact portion provided in front of the fixing portion and a tail portion provided behind the fixing portion, the contact portion is provided relatively in front of the bottom surface and protrudes into the insertion slot to be electrically connected to the first component, and the tail portion is electrically connected to the second component; and at least one insulating block, installed in the insulating body, wherein the fixing portion of each of the first signal terminals and the fixing portion of each of the first ground terminals are respectively fixed to one of the at least one insulating block; wherein one of the first separation walls exists between each of the first signal terminals and an adjacent one of the first ground terminals, and one of the first ribs exists between each pair of the pairs of first signal terminals.

Further, an accommodating space and a protruding block are backward provided on a front surface of the insulating block, and an inner side surface of the protruding block forms a side wall of the accommodating space; and a back end of each of the first separation walls has a first portion extending backward into the accommodating space, each two adjacent ones of the first portions of the first separation walls and the inner side surface of the protruding block altogether form an air slot, inner sides of each pair of the pairs of first signal terminals are provided with one air slot, defined as a first air slot, an inner side of each of the first ground terminals is provided with another air slot, defined as a second air slot, and a size of the first air slot in the left-right direction is greater than a size of the second air slot in the left-right direction.

Further, one side of the fixing portion of each of the terminals close to the contact portion has a cushion portion, the protruding block has a first hole concavely provided from the inner side surface of the protruding block, the first hole is communicated with the first air slot and exposes the cushion portions of one pair of the pairs of first signal terminals, and two sides of the first hole in the left-right direction are provided to be outer relative to two sides of the first air slot in the left-right direction.

Further, the insulating body has an accommodating slot concavely provided forward from a rear thereof, the accommodating slot has a positioning plain surface located on a bottom portion thereof in a vertical direction, the side walls has a second side wall located below the first side wall, the first side wall and the second side wall face each other in the vertical direction, the insertion slot is located between the first side wall and the second side wall, the second side wall has a plurality of second separation walls and a plurality of second ribs, each of the second ribs has a free end portion located in front of the bottom surface, and each of the second separation walls continuously extends backward from a front thereof and passes backward beyond the bottom surface; the terminals comprise a plurality of pairs of second signal terminals and a plurality of second ground terminals arranged on the second side wall along the first direction, each pair of the pairs of the second signal terminals is configured to transmit differential signals, each of two sides of each pair of the pairs of the first signal terminals is provided with an adjacent one of the second ground terminals, one of the second separation walls exists between each of the second signal terminals and the adjacent one of the second ground terminals, and one of the second ribs exists between each pair of the pairs of the second signal terminals; and the electrical connector comprises two insulating blocks, the fixing portion of each of the second signal terminals and the fixing portion of each of the second ground terminals are respectively fixed to another one of the two insulating blocks, and the two insulating blocks are accommodated in the accommodating slot and are both in contact with the positioning plain surface to perform positioning.

Compared with the related art, according to certain embodiments of the present invention, a pair of the first signal terminals have a pair of adjusting portions extending out of the surface of the insulating block and not passing forward beyond the bottom surface of the insertion slot, and the medium between the pair of the adjusting portions is only the first medium. The dielectric coefficient of the first medium is less than the dielectric coefficient of the insulating body. Part of the signal of each signal contact of the first component is transmitted to the contact portion of a corresponding first signal terminal, and is sequentially transmitted to the connecting portion, the fixing portion and the tail portion through the contact portion. The part of the signal is a valid signal. Some of the signal of each signal contact of the first component diverges to the environment in the form of magnetic wave, forming interference magnetic wave that causes interference to the surrounding first signal terminals. When the first component is inserted backward into the insertion slot, the signal contacts of the first component are stopped in front of the bottom surface or stopped right at the bottom surface, and the pair of the adjusting portions of a pair of the first signal terminals are provided not to pass beyond the bottom surface, increasing a distance between the adjusting portion and the signal contact of the first component, thus reducing the effect of the interference magnetic wave of the signal contact of the first component to the transmission of the valid signal of the adjusting portion, such that more valid signals are transmitted to the adjusting portion. Further, the dielectric coefficient of the first medium between the pair of the adjusting portions is less than the dielectric coefficient of the insulating body, which is more conducive to the signal coupling between the pair of the adjusting portions, such that more valid signals are transmitted by the pair of the adjusting portions, increasing the valid signals transmitted to the adjusting portion of the first signal terminal, such that more valid signals reach the tail portion of the terminal, thereby increasing the signal output efficiency of the electrical connector, such that the signal output efficiency of the electrical connector is good. One of the first ribs exists between each pair of the first signal terminals, ensuring the pair of the first contact portions to be always separated by the first rib in the moving process, preventing the pair of the first contact portions from mistakenly touching each other due to movement and causing short-circuiting. The free end of the first rib is located in front of the bottom surface, such that the air content between the pair of the first signal terminals increases, thereby reducing the dielectric coefficient between the pair of the first signal terminals, which is conducive to the high frequency signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

Figure 1:
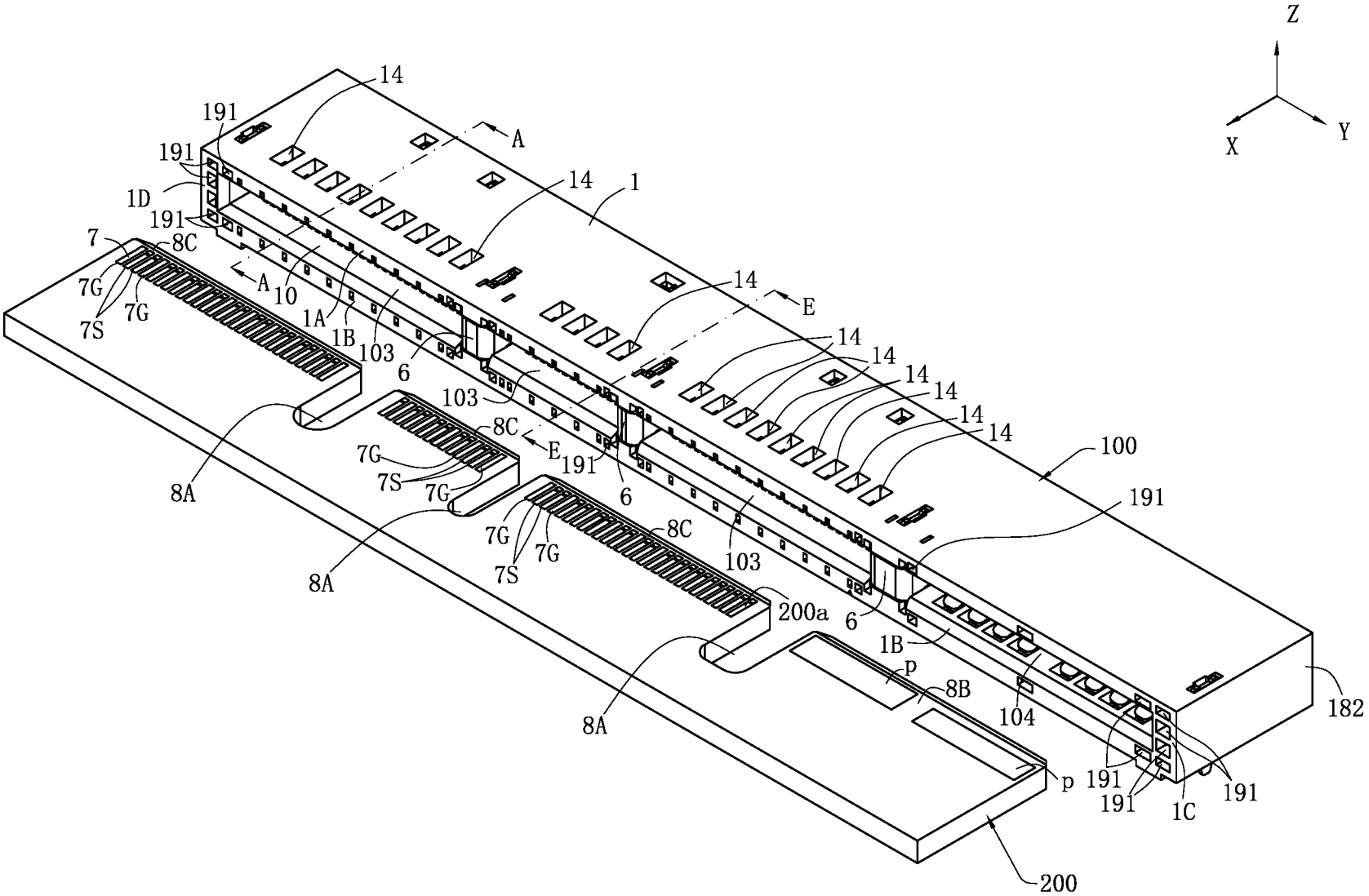
FIG. 1 is a perspective assembly view of an electrical connector according to certain embodiments of the present invention.

Reference numbers in the drawings include:

| | |
|---|---|
| electrical connector 100 | |
| insulating body 1 | insertion slot 10 |
| first side wall 1A | second side wall 1B |
| third side wall 1C | fourth side wall 1D |
| bottom wall 1E | first side surface 101 |
| second side surface102 | functional insertion slot 103 |
| power insertion slot 104 | bottom surface 105 |
| foolproof rib 11 | first signal slot 101s |
| first ground slot 101g | first separation wall 12 |
| first slot 120 | first portion 121 |
| first rib 13 | free end 131 |
| first window 14 | second signal slot 102s |
| second ground slot 102g | second separation wall 15 |
| second slot 152 | second portion 151 |
| second rib 16 | free end portion 161 |
| second window 17 | accommodating slot 18 |
| upper stopping wall 181 | left stopping wall 182 |
| right stopping wall 183 | stopping block 184 |
| positioning slot 185 | positioning plain surface 1851 |
| power accommodating slot 18p | functional accommodating slot 18s |
| front hollow slot 191 | rear hollow slot 192 |
| terminal C | first terminal 2 |
| first signal terminal 2S | first ground terminal 2G |
| first power terminal 2P | first bridging portion 2P1 |
| first cantilever 2P2 | first fixing leg 2P3 |
| first fixing portion 20 | first elastic portion 21 |
| first tail portion 22 | |
| first cushion portion 201 | first horizontal portion 202 |
| first extending portion 203 | |
| first contact portion 210 | front intersection line F |
| rear intersection line R | first abutting portion 2101 |
| first transition portion 2102 | first guiding corner 2103 |
| first connecting portion 211 | first adjusting portion 2111 |
| first oblique portion 2112 | first bending portion 2113 |
| second terminal 3 | second signal terminal 3S |
| second ground terminal 3G | |
| second power terminal 3P | second bridging portion 3P1 |
| second cantilever 3P2 | second fixing leg 3P3 |
| second fixing portion 30 | second elastic portion 31 |
| second tail portion 32 | |
| second cushion portion 301 | second horizontal portion 302 |
| second extending portion 303 | |
| second contact portion 310 | second abutting portion 3101 |
| second transition portion 3102 | second connecting portion 311 |
| second adjusting portion 3111 | second oblique portion 3112 |
| second bending portion 3113 | second guiding corner 3103 |
| fixing block 4 | |
| insulating block 5 | accommodating space 50 |
| first insulating block 51 | second insulating block 52 |
| main body 510 | empty slot 5100 |
| first exposing hole 5101 | third abutting rib 5102 |
| second exposing hole 5103 | |
| first protruding block 511 | first hole 512 |
| second hole 513 | first abutting rib 514 |
| first air slot 515 | second air slot 516 |
| guiding slot 517 | |
| second protruding block 521 | third hole 522 |
| fourth hole 523 | second abutting rib 524 |
| third air slot 525 | fourth air slot 526 |
| metal member 6 | elastic abutting arm 61 |
| electronic card 200 | first contact 7 |
| first signal contact 7S | first ground contact 7G |
| first power contact 7P | |
| power insertion portion 8B | functional insertion portion 8C |
| foolproof slot 8A | |
| functional module M | power module E |
| positioning block T | |

-continued

| | |
|---|---|
| front-rear direction X | left-right direction Y |
| vertical direction Z | |
| first width W1 | first distance d1 |
| second distance d2 | |
| width P1, P2, P3, P4, P5, P6 | |

DETAILED DESCRIPTION

The present invention is more particularly described in the following examples that are intended as illustrative only since numerous modifications and variations therein will be apparent to those skilled in the art. Various embodiments of the invention are now described in detail.

To better understand the technical solutions of the present invention, in the three-dimensional coordinate of the drawings, the X-axis is defined as a front-rear direction, the Y-axis is defined as a left-right direction (first direction), and the Z-axis is defined as a vertical direction (second direction).

Figure 2:
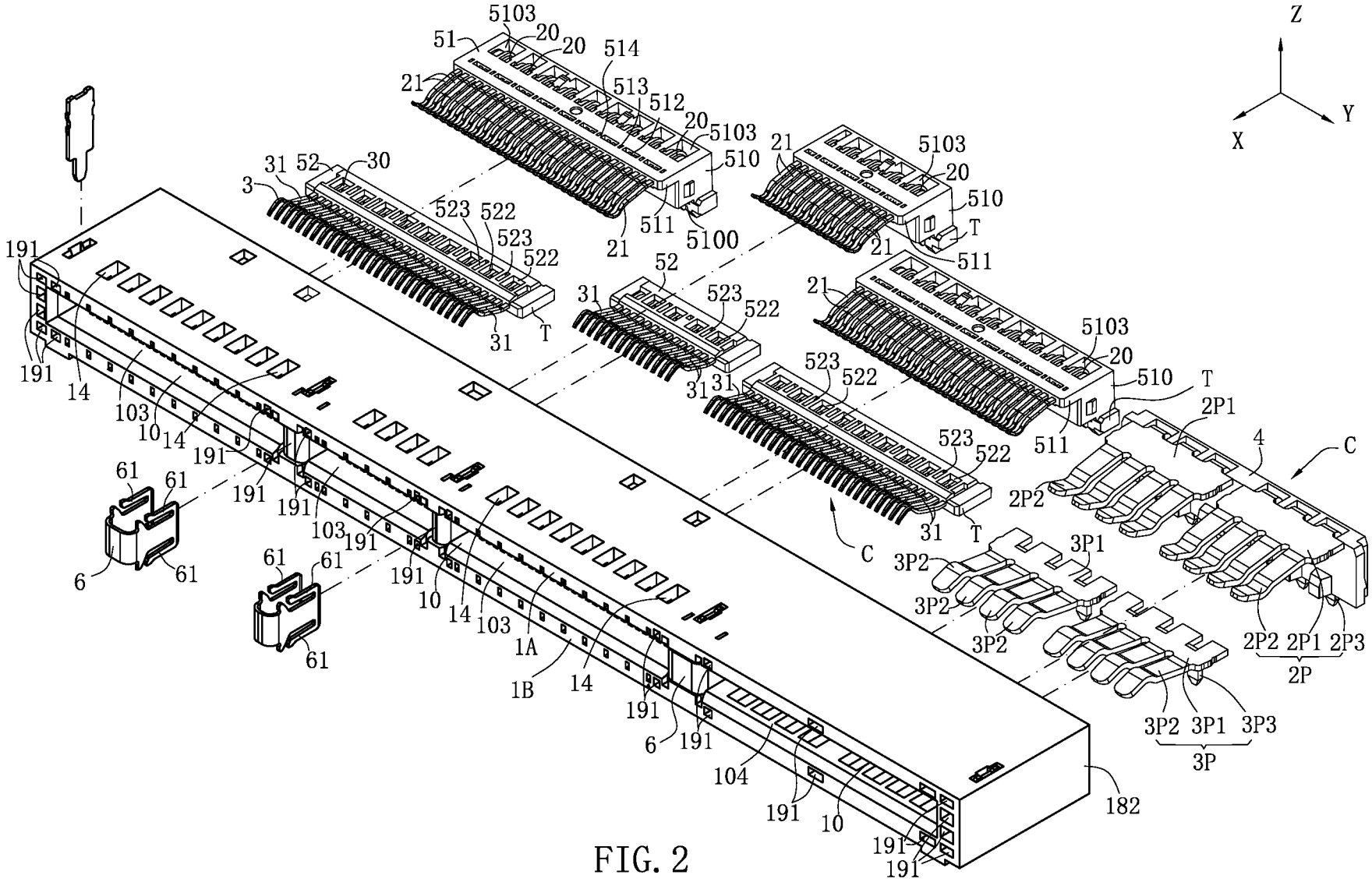
FIG. 2 is a perspective exploded view of an electrical connector according to certain embodiments of the present invention.
Figure 11:
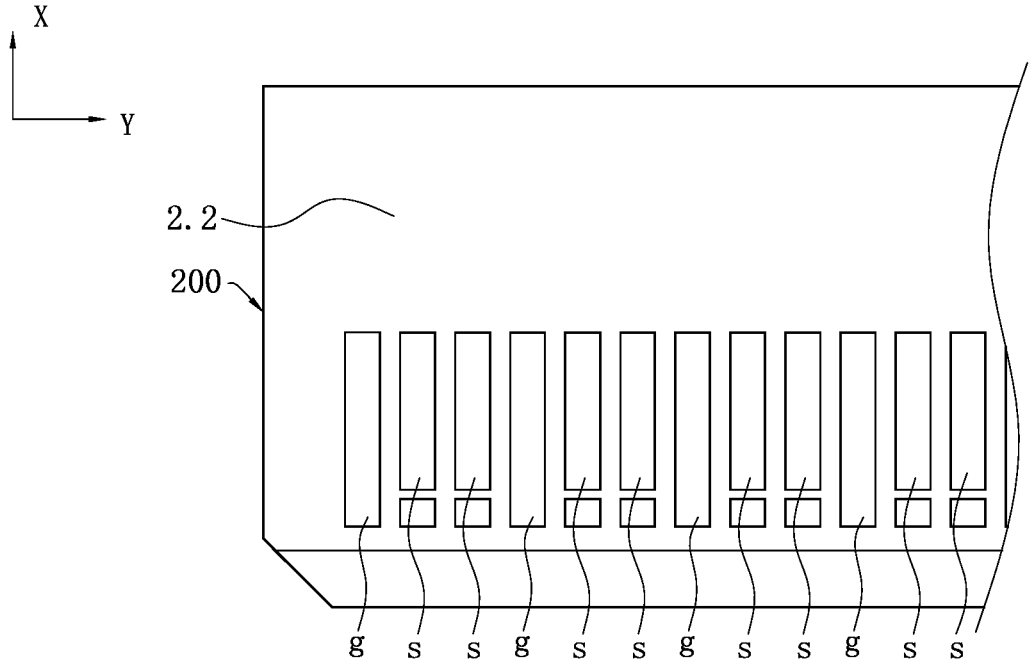
FIG. 11 is a partial plain sectional view of the electrical connector of FIG. 6 along line B-B.
Figure 11:
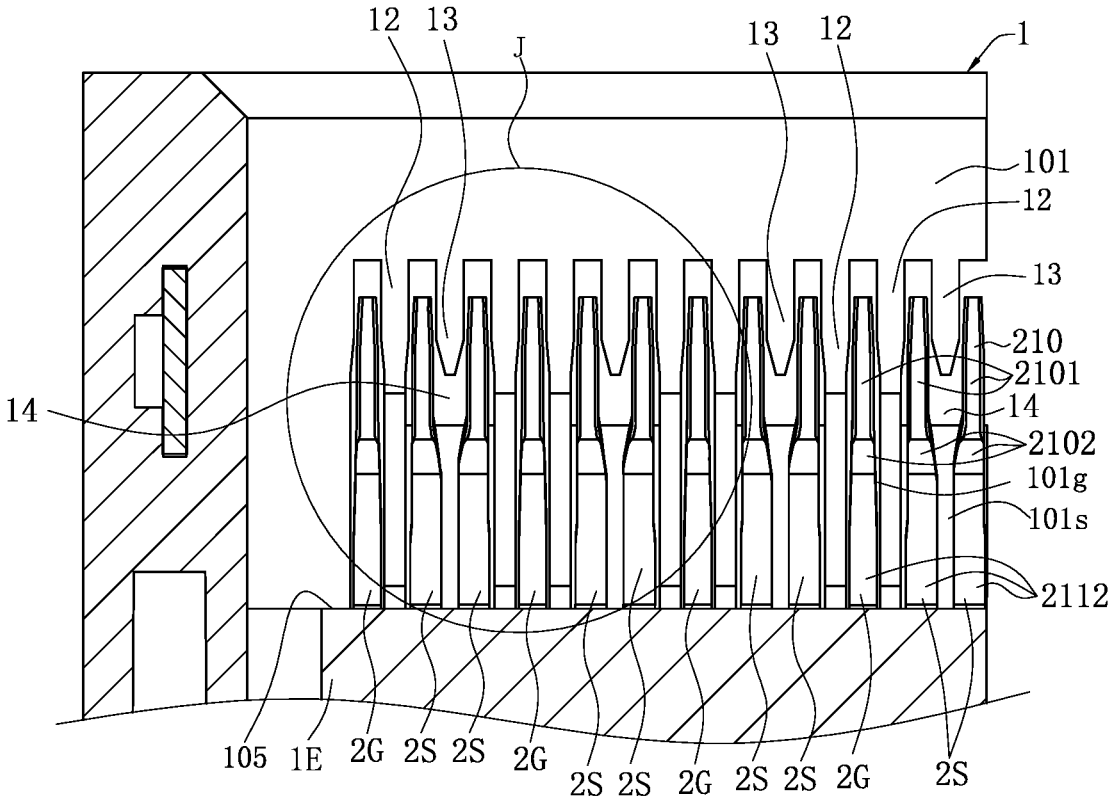

Referring to FIG. 1, FIG. 2 and FIG. 11, an electrical connector 100 according to certain embodiments of the present invention is shown. The electrical connector 100 is used for a first component to insert therein and is mounted to a second component (not shown, same below). In this embodiment, the first component is an electronic card 200. Two opposite plate surfaces of an insertion end of the electronic card 200 are respectively provided with a row of first contacts 7 and a row of second contacts (not shown, same below). The row of first contacts 7 are provided by a plurality of first contacts 7 in a row along the left-right direction Y, and the row of first contacts 7 have a plurality of pairs of first signal contacts 7S, a plurality of first ground contacts 7G and a plurality of first power contacts 7P. Each of a left side and a right side of each pair of the first signal contacts 7S has one of the first ground contacts 7G. The row of second contacts (not shown, same below) are provided by a plurality of second contacts in a row along the left-right direction Y, and the row of second contacts have a plurality of pairs of second signal contacts (not shown, same below), a plurality of second ground contacts (not shown, same below) and a plurality of second power contacts (not shown, same below). Each of a left side and a right side of each pair of the second signal contacts has one of the second ground contacts. The insertion end (unnumbered) has a plurality of foolproof slots 8A. Each foolproof slot 8A is provided to open along its insertion direction, and the foolproof slots 8A are provided at intervals in the left-right direction. The foolproof slots 8A divide the insertion end of the electronic card 200 into a power insertion portion 8B and three functional insertion portions 8C. The first power contacts 7P and the second power contacts (not shown) are symmetrically provided on the two plate surfaces of the power insertion portion 8B. On the two plate surfaces of each functional insertion portion 8C, each pair of the first signal contacts 7S and each pair of the second signal contacts are provided opposite to each other, and the first ground contacts 7G and the second ground contacts are provided opposite to each other. In similar embodiments, it is not limited to the electronic card 200, and it may be a plug connector having an insertion tongue. In this embodiment, the second component is a circuit board (not shown), and in similar embodiments, it is not limited to the circuit board (not shown), and it may be another connector (not shown) or a cable (not shown), etc.

Figure 3:
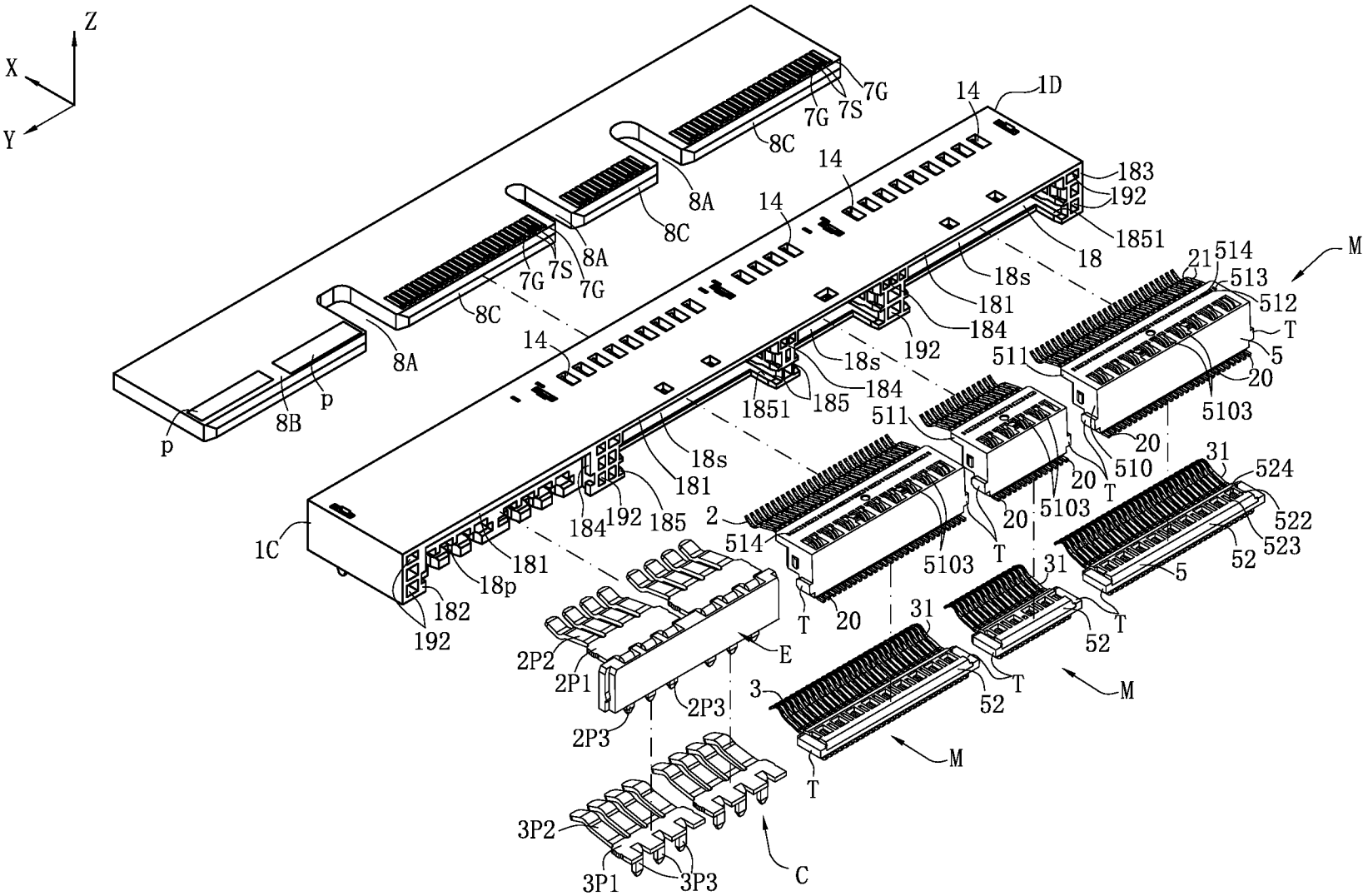
FIG. 3 is a perspective exploded view of an electrical connector from another viewing angle according to certain embodiments of the present invention.

Referring to FIG. 1, FIG. 2 and FIG. 3, the electrical connector 100 has an insulating body 1. The insulating body 1 has an insertion slot 10 used for the electronic card 200 to insert therein. A plurality of terminals C are respectively provided at two sides of the insertion slot 10, and a front end of each terminal C partially protrudes into the two sides of the insertion slot 10. The terminals C include a plurality of first terminals 2, two first power terminals 2P, a plurality of second terminals 3 and two second power terminals 3P.

Referring to FIG. 1, FIG. 2 and FIG. 3, the first terminals 2 and the two first power terminals 2P are provided at one side of the insertion slot 10, and facilitate signal transmission with the row of first contacts 7 of the electronic card 200. The second terminals 3 and the two second power terminals 3P are provided at the other side of the insertion slot 10, and facilitate signal transmission with the row of second contacts. A rear end of each terminal C extends out of the insulating body 1 to be conductively connected to the circuit board (not shown), such that the electrical connector 100 electrically connects the electronic card 200 and the circuit board (not shown).

Referring to FIG. 1, FIG. 2 and FIG. 3, the insulating body 1 is formed by an insulating material. A front surface of the insulating body 1 is backward concavely provided with the insertion slot 10, a first side wall 1A, a second side wall 1B, a third side wall 1C and a fourth side wall 1D connected sequentially and surroundingly forming the insertion slot 10, and a bottom wall 1E located behind the insertion slot 10. The insertion slot 10 is provided longitudinally along the left-right direction Y. The first side wall 1A and the second side wall 1B are opposite to each other vertically and are provided longitudinally along the left-right direction Y. The third side wall 1C and the fourth side wall 1D are located at a left end and a right end of the insertion slot 10.

Figure 6:
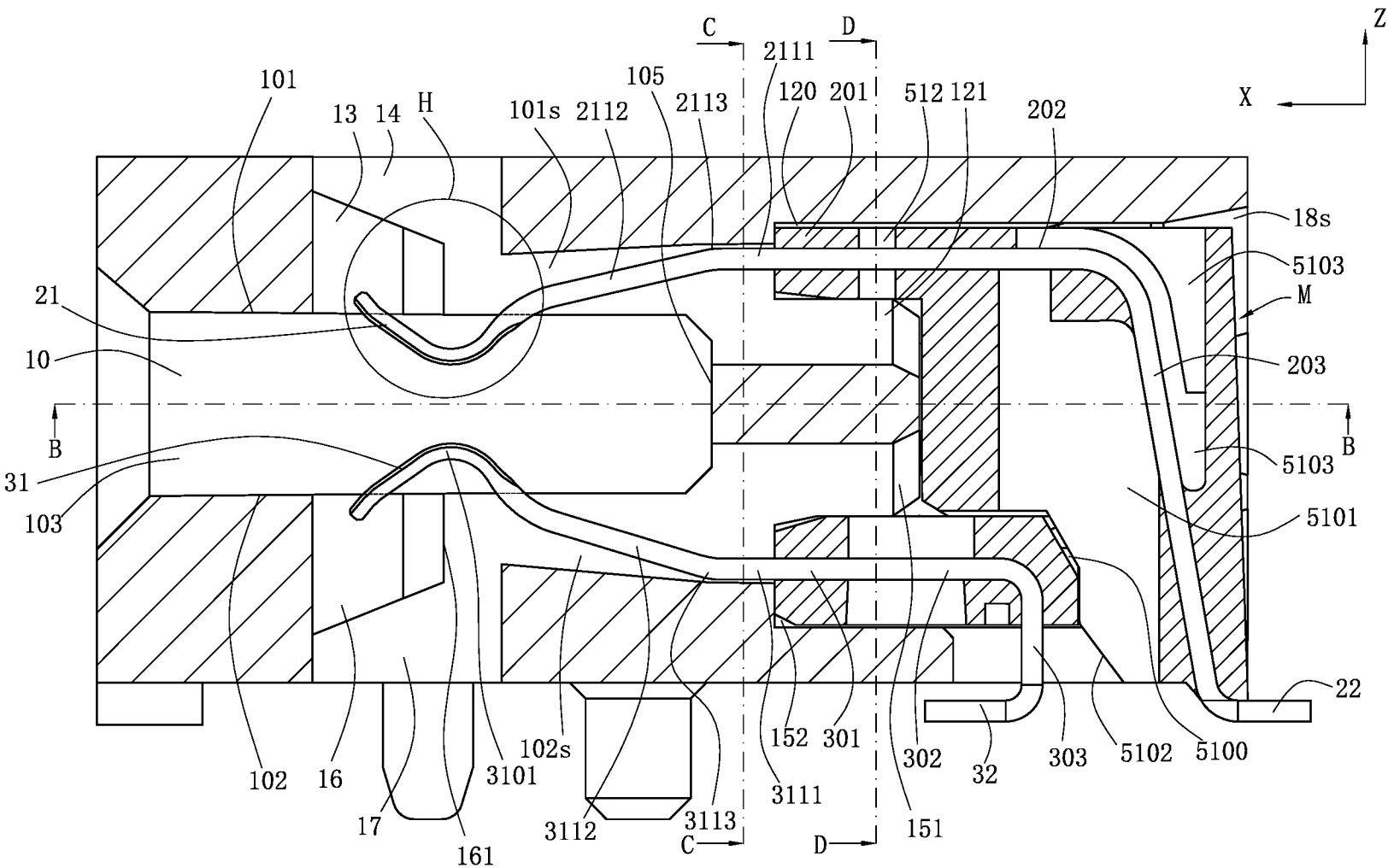
FIG. 6 is a plain sectional view of the electrical connector in FIG. 1 along line A-A.

Referring to FIG. 1, FIG. 2 and FIG. 6, the first side wall 1A has a first side surface 101 facing the insertion slot 10. The second side wall 1B has a second side surface 102 facing the insertion slot 10, and the second side surface 102 and the first side surface 101 are opposite to each other. A front surface of the bottom wall 1E forms a bottom surface 105 of the insertion slot 10. The insertion slot 10 has a plurality of foolproof ribs 11 arranged sequentially at intervals rightward from a left thereof to one-to-one match with the foolproof slots 8A, thereby achieving the foolproof effect. Each foolproof rib 11 is located between the third side wall 1C and the fourth side wall 1D, and is connected vertically to the first side wall 1A and the second side wall 1B.

Referring to FIG. 1 and FIG. 2, the insertion slot 10 is separated by the foolproof ribs 11 to form three functional insertion slots 103 and a power insertion slot 104. The three functional insertion slots 103 are used to one-to-one accommodate the three functional insertion portions 8C, and the power insertion slot 104 is used to accommodate the power insertion portion 8B. The three functional insertion slots 103 are arranged sequentially and continuously rightward from a left thereof, and the power insertion slot 104 is located at one side of the three functional insertion slots 103. Since the electrical connector 100 mainly facilitates the fixing effect corresponding to the electronic card 200 by the inner walls of the insertion slot 10 and the terminals C to clamp vertically, the foolproof ribs 11 increase the fixing area of the inner walls of the insertion slot 10 and the electronic card 200, thereby increasing the fixing strength of the electrical connector 100 to the electronic card 200.

Referring to FIG. 1 and FIG. 2, the electrical connector 100 further has a plurality of metal members 6. Each metal member 6 is formed by punching and bending a metal plate material. Each metal member 6 is provided in a U-shape, and is provided on each foolproof rib 11, thereby protecting the foolproof ribs 11, and preventing them from excessive wear. Each metal member 6 has a plurality of elastic abutting arms 61. Each of the first side wall 1A and the second side wall 1B is fixed and matched with the elastic abutting arms 61 of each metal member 6.

The difference of the three functional insertion slots 103 exists in the different lengths, and other structures thereof are similar. In other embodiments, the quantity of the functional insertion slots 103 may be adjusted according to high frequency requirements.

Figure 8:
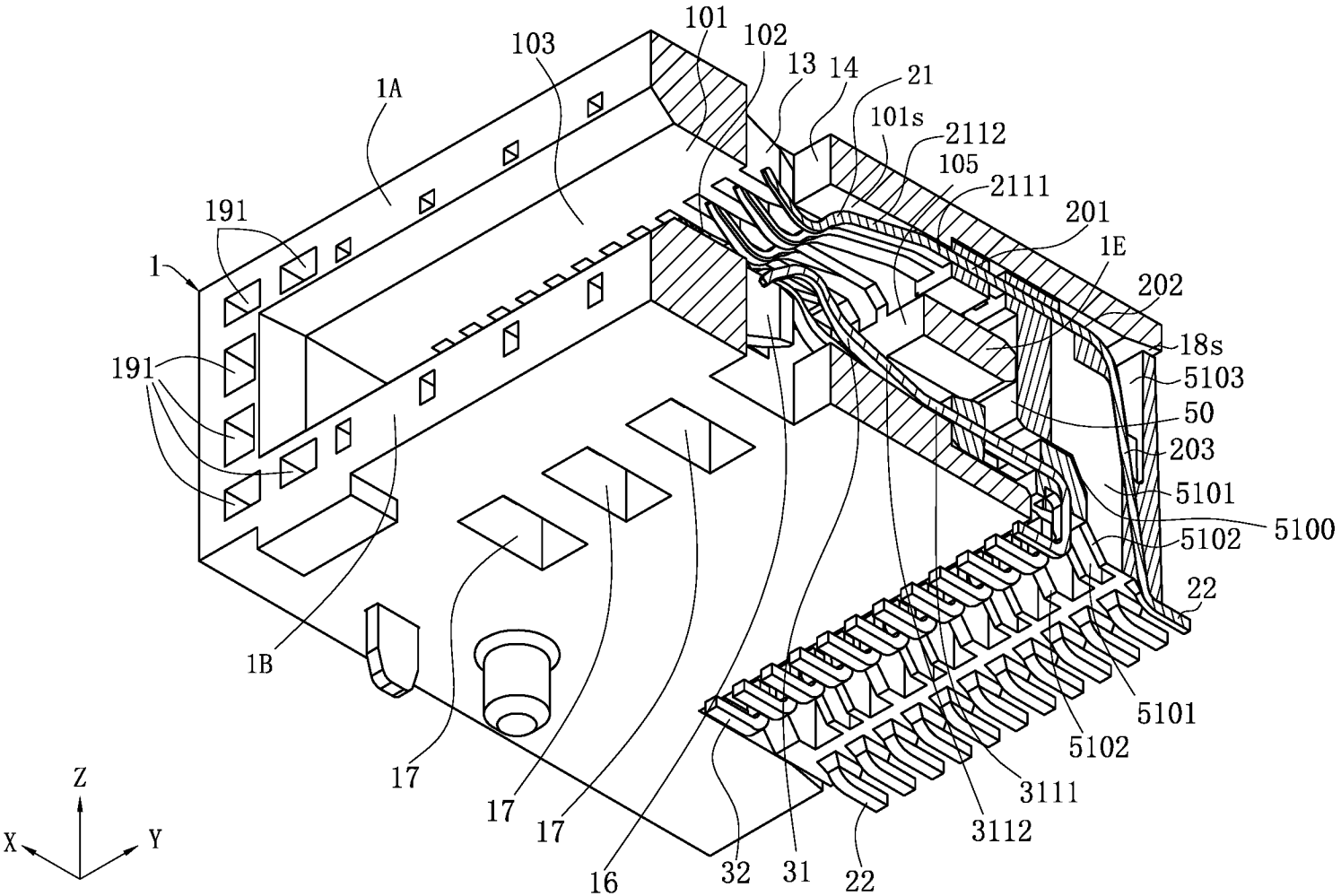
FIG. 8 is a partial sectional perspective view of the electrical connector of FIG. 6 according to certain embodiments of the present invention.

Referring to FIG. 6, FIG. 8 and FIG. 11, the first side wall 1A of each functional insertion slot 103 has a plurality of first signal slots 101*s* and a plurality of first ground slots 101*g* provided alternately along the left-right direction Y. That is, each of a left side and a right side of one of the first signal slots 101*s* has one of the first ground slots 101*g*. The first signal slots 101*s* and the first ground slots 101*g* are all provided to penetrate through the first side surface 101 to be communicated with the insertion slot 10. A width of each first signal slot 101*s* along the left-right direction Y is greater than twice a width of each first ground slot 101*g* along the left-right direction Y.

Figure 12:
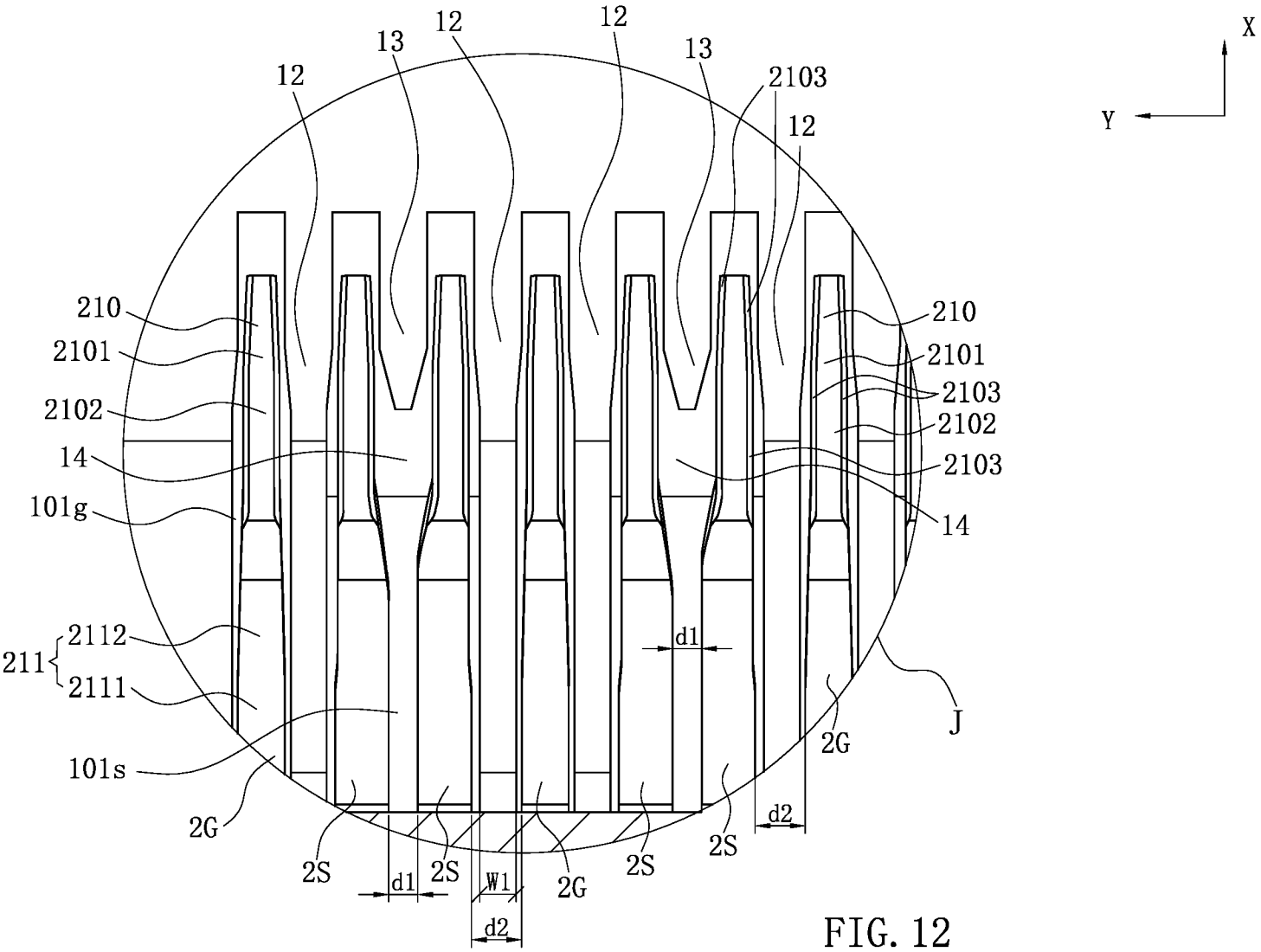
FIG. 12 is a partial sectional view of FIG. 11.

Referring to FIG. 6, FIG. 11 and FIG. 12, the first side wall 1A of each functional insertion slot 103 has a plurality of first separation walls 12, arranged sequentially in a row along the left-right direction Y. Each first separation wall 12 defines a first width W1 in the left-right direction Y. Each first separation wall 12 is located between one of the first signal slots 101*s* and its adjacent one of the first ground slots 101*g*, and each first separation wall 12 is fixed forward to a front surface of the one of the first signal slots 101*s* and a front surface of its adjacent one of the first ground slots 101*g*. The first separation walls 12 continuously extend backward from a front thereof to a rear surface of the bottom wall 1E. That is, the rear surface of each first separation wall 12 and the rear surface of the bottom wall 1E are located on a same vertical plane. Portions of the first separation walls 12 passing backward beyond the front surface of the bottom wall 1E (that is, the bottom surface 105 of the insertion slot 10) are fixed and connected to an upper surface of the bottom wall 1E, and the fixing and connecting locations are continuous from the front surface of the bottom wall 1E to the rear surface of the bottom wall 1E. A portion of the rear surface of each first separation wall 12 is forward concavely provided with a first slot 120 and a first portion 121 located below the first slot 120. An upper surface of the first portion 121 forms a side wall of the first slot 120, and a lower end of the first portion 121 is fixed and connected to the bottom wall 1E.

Referring to FIG. 6, FIG. 8 and FIG. 12, the first side wall 1A has a first rib 13 formed by extending backward from the front surface of each first signal slot 101*s*. A rear of the first rib 13 has a free end 131, and the free end 131 is located in front of the bottom surface 105 and is provided to be at an interval with the bottom surface 105 in the front-rear direction. Distances between each first rib 13 and its two adjacent first separation walls 12 along the left-right direction Y are equal.

Referring to FIG. 2, FIG. 8 and FIG. 11, the first side wall 1A further has a plurality of first windows 14. Each first window 14 penetrates upward through the upper outer surface of the first side wall 1A, and is communicated downward with a first signal slot 101*s*, and the first rib 13 as a whole is exposed outward in the first window 14. However, the upper part of each first ground slot 101*g* is isolated at the upper side by a portion of the insulating material of the first side wall 1.1. In other embodiments, the upper part of each first ground slot 101*g* may be correspondingly provided with a window penetrating upward through the upper outer surface of the first side wall 1A.

Figure 13:
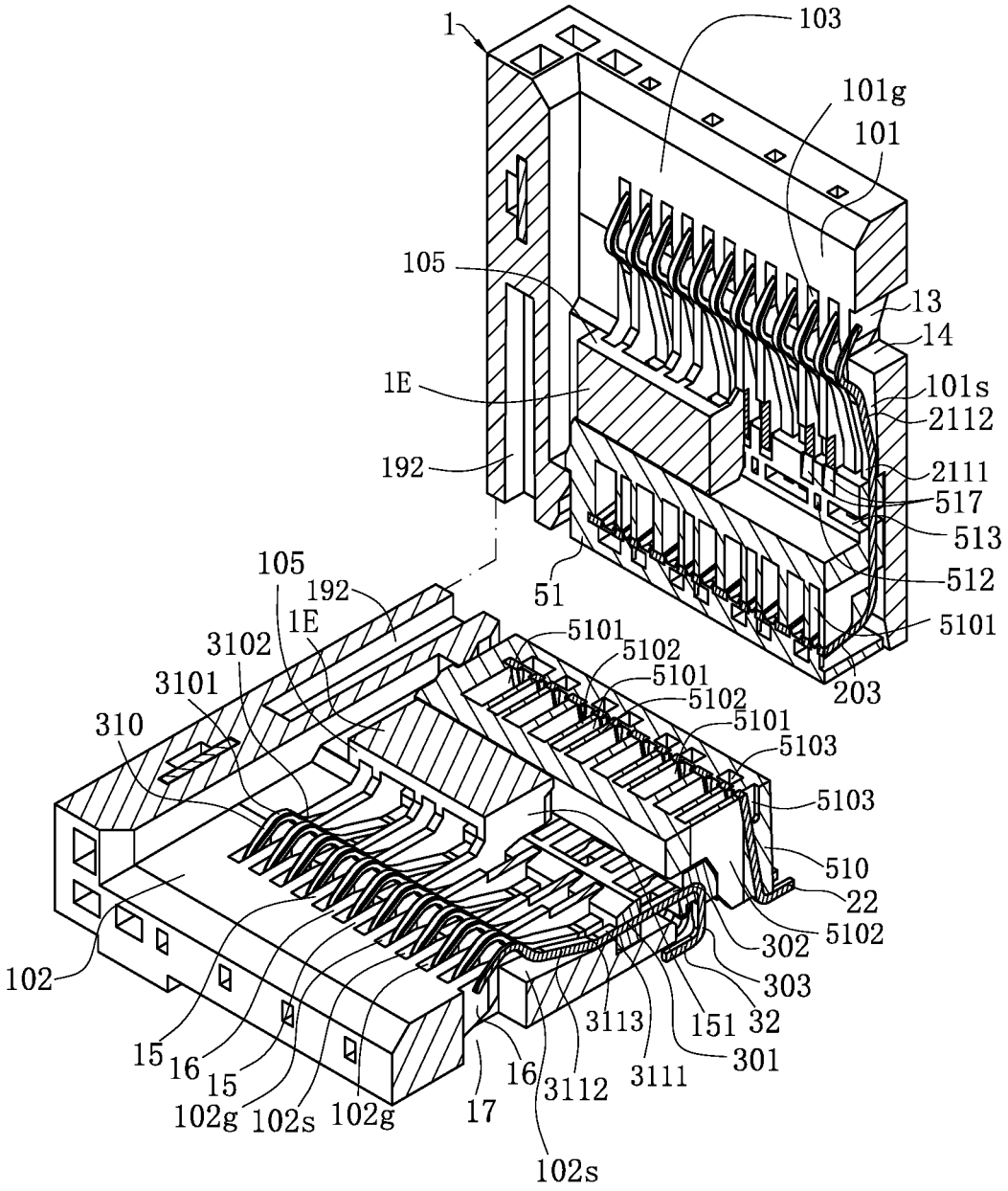
FIG. 13 is a partial sectional view of the electrical connector of FIG. 6.
Figure 14:
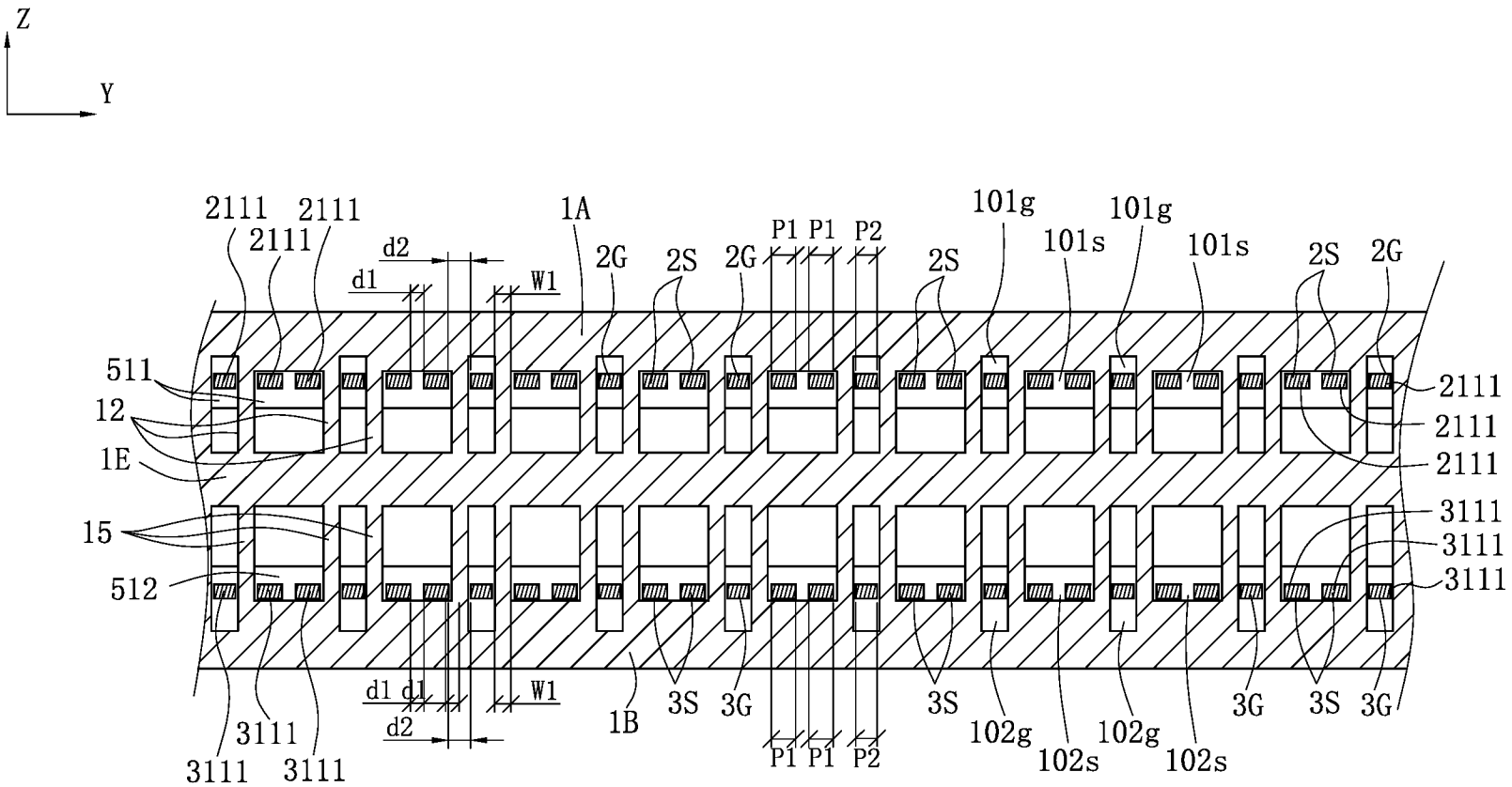
FIG. 14 is a partial sectional view of FIG. 6 along line C-C.

Referring to FIG. 6, FIG. 13 and FIG. 14, the second side wall 1B of each functional insertion slot 103 has a plurality of second signal slots 102*s* and a plurality of second ground slots 102*g* provided alternately along the left-right direction Y. That is, each of a left side and a right side of one of the second signal slots 102*s* has one of the second ground slots 102*g*. The second signal slots 102*s* and the second ground slots 102*g* are all provided to penetrate through the second side surface 102 to be communicated with the insertion slot 10. The second signal slots 102*s* and the first signal slots 101*s* are opposite to each other vertically and one-to-one corresponding to each other, and the second ground slots 102*g* and the first ground slots 101*g* are provided corresponding to each other vertically and one-to-one corresponding to each other.

Figure 15:
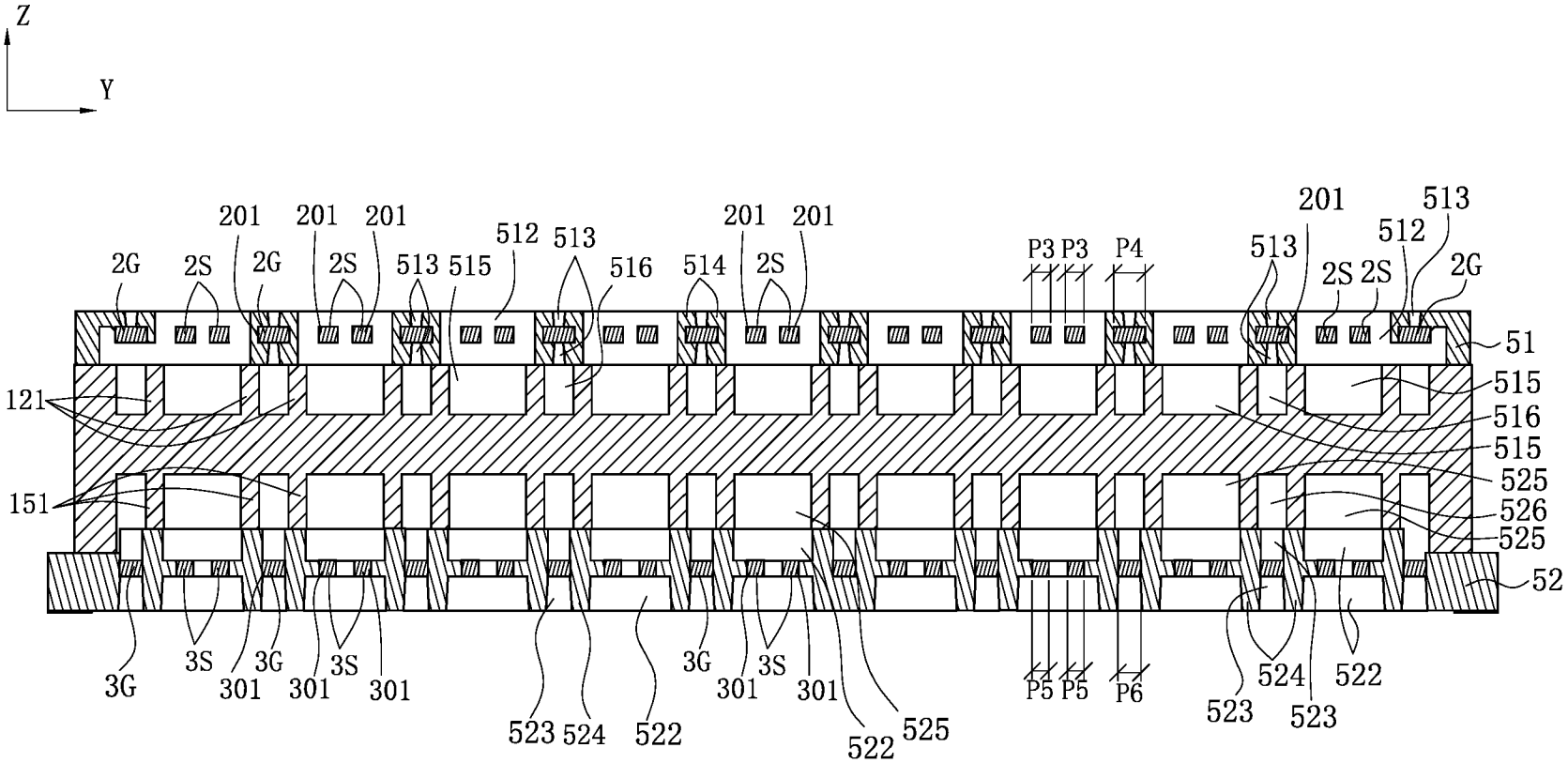
FIG. 15 is a partial sectional view of FIG. 6 along line D-D.

Referring to FIG. 6, FIG. 13 and FIG. 15, the second side wall 1B of each functional insertion slot 103 has a plurality of second separation walls 15, arranged sequentially along the left-right direction Y. A width of each second separation wall 15 equals the first width W1. Each second separation wall 15 is located between one of the second signal slots 102*s* and its adjacent one of the second ground slots 102*g*, and each second separation wall 15 is fixed forward to a front surface of the one of the second signal slots 102*s* and a front surface of its adjacent one of the second ground slots 102*g*. The second separation walls 15 continuously extend backward from a front thereof to the rear surface of the bottom wall 1E. That is, the rear surface of each second separation wall 15 and the rear surface of the bottom wall 1E are located on a same vertical plane. Each second separation wall 15 and each first separation wall 12 are provided one-to-one corresponding to each other vertically. Portions of the second separation walls 15 passing backward beyond the front surface of the bottom wall 1E (that is, the bottom surface 105 of the insertion slot 10) are fixed and connected to a lower surface of the bottom wall 1E, and the fixing and connecting locations are continuous from the front surface of the bottom wall 1E to the rear surface of the bottom wall 1E. A portion of the rear surface of each second separation wall 15 is forward concavely provided with a second slot 152 and a second portion 151 located below the second slot 152. An upper surface of the second portion 151 forms a side wall of the second slot 152, and an upper end of the second portion 121 is fixed and connected to the bottom wall 1E.

Referring to FIG. 6 and FIG. 12, the second side wall 1B has a second rib 16 formed by extending backward from the front surface of each second signal slot 102*s*. A rear of the second rib 16 has a free end portion 161, and the free end portion 161 is located in front of the bottom surface 105 and is provided to be at an interval with the bottom surface 105 in the front-rear direction. The second rib 16 and the first rib 13 are provided one-to-one corresponding to each other vertically. Distances between each second rib 16 and its two adjacent second separation walls 15 along the left-right direction Y are equal.

Referring to FIG. 6, FIG. 8 and FIG. 13, the second side wall 1B further has a plurality of second windows 17. Each second window 17 penetrates downward through the lower outer surface of the second side wall 1B, and is communicated upward with a second signal slot 102*s*, and the second rib 16 as a whole is exposed outward in the second window 17. However, the lower part of each second ground slot 102*g* is isolated at the lower side by a portion of the insulating material of the second side wall 1.2. In other embodiments, the lower part of each second ground slot 102*g* may be correspondingly provided with a window penetrating downward through the lower outer surface of the second side wall 1B.

Referring to FIG. 1, FIG. 2 and FIG. 3, the rear end of the insulating body 1 has an accommodating slot 18 forward concavely provided and an upper stopping wall 181, a left stopping wall 182 and a right stopping wall 183 enclosing the accommodating slot 18. A front side inner wall of the accommodating slot 18 is formed by a rear surface of the bottom wall 1E, rear surfaces of the first separation walls 12 and rear surfaces of the second separation walls 15, and the accommodating slot 18 opens downward. The left stopping wall 182 and the right stopping wall 183 are located at a left end and a right end of the insulating body 1, respectively correspond to the third side wall 1C and the fourth side wall 1D in the front-rear direction, and both extend backward to the rear surface of the insulating body 1. The rear end of the insulating body 1 has a plurality of stopping blocks 184 located in the accommodating slot 18 and extending backward to the rear surface of the insulating body 1. Each stopping block 184 and each foolproof rib 11 one-to-one correspond to each other in the front-rear direction. The stopping blocks 184 separate the accommodating slot 18 into three functional accommodating slots 18*s* and a power accommodating slot 18*p*. Each functional accommodating slot 18*s* and each functional insertion slot 103 correspond to each other in the front-rear direction. The first signal slots 101*s*, the first ground slots 101*g*, the second signal slots 102*s* and the second ground slots 102*g* are all communicated backward to the functional accommodating slots 18*s*. The power accommodating slot 18*p* is provided behind the power insertion slot 104.

Figure 17:
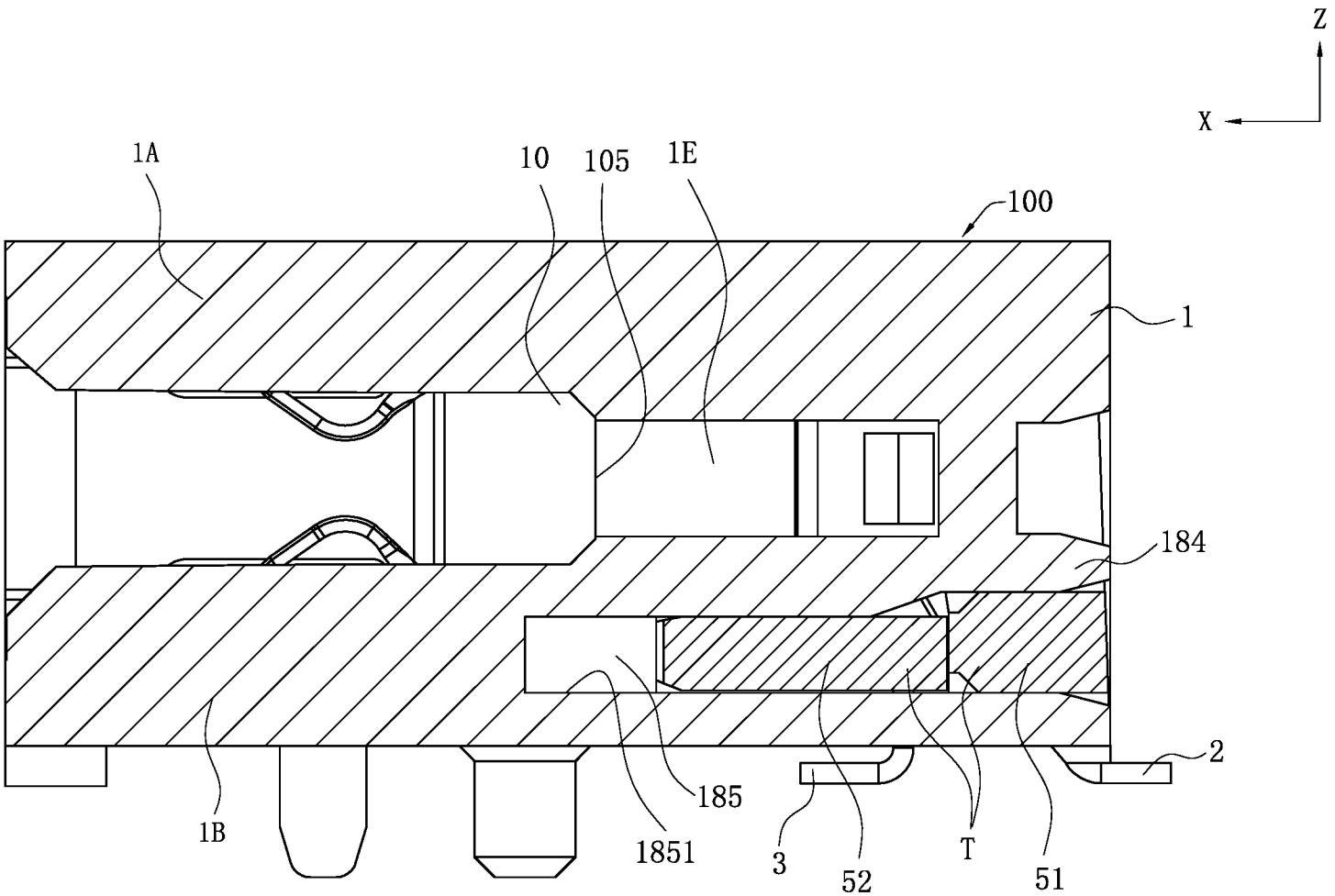
FIG. 17 is a sectional view of the electrical connector of FIG. 1 along line E-E.

Referring to FIG. 3 and FIG. 17, the accommodating slot 18 is provided with a plurality of positioning slots 185. In this embodiment, all of the three functional accommodating slots 18*s* are provided with the positioning slots 185, and the power accommodating slot 18*p* is not provided with any positioning slot 185. A rear surface of the right stopping wall 183 is forward concavely provided with one of the positioning slots, and the rear surface of each stopping block 184 is forward concavely provided with at least one of the positioning slots 185. Each of a left side and a right side of the stopping block 184 between two adjacent ones of the functional accommodating slots 18*s* is provided with one of the positioning slots 185. The stopping block 184 between the power accommodating slot 18*p* and its adjacent functional accommodating slot 18*s* is only provided with one of the positioning slots 185. In the vertical direction Z, the lower walls of the positioning slots 185 form a positioning plain surface 1851.

Referring to FIG. 2, FIG. 3 and FIG. 6, a plurality of front hollow slots 191 are backward concavely provided on the front surface of the insulating body 1 and on the first side wall 1A, the second side wall 1B, the third side wall 1C and the fourth side wall 1D. The front hollow slots 191 surround the whole insertion slot 10 in the upward, downward, leftward and rightward directions. That is, the periphery of the three functional insertion slots 103 and the power insertion slot 104 all have the front hollow slots 191. A plurality of rear hollow slots 192 are forward concavely provided on the rear surface of the insulating body 1. The rear hollow slots 192 are forward concavely provided on the rear surface of the left stopping wall 182, the rear surface of the right stopping wall 183 and the rear surface of each stopping block 184.

In this embodiment, the insulating body 1 is injection-molded by an insulating material in a mold. After the molded insulating body 1 is taken out of the mold, it is performed with natural cooling. In the cooling process, due to thermal expansion and contraction in the insulating body 1, the cooling speed of the portion with more material and thicker sizes is slower than that of the portion with less material and thinner sizes. If the front hollow slots 191 were not provided, due to the thicknesses of the first side wall 1A, the second side wall 1B, the third side wall 1C and the fourth side wall 1D being relatively thicker, in the cooling process of the insulating body 1, the cooling speed of the first side wall 1A, the second side wall 1B, the third side wall 1C and the fourth side wall 1D is relatively slower, such that their positions deviate, thereby not ensuring the accuracy of the insertion slot, and resulting in ill mating of the insertion slot 10 and the electronic card 200. Similarly, if the rear hollow slots 192 were not provided, surfaces of the upper stopping wall 181, the left stopping wall 182, the right stopping wall 183 and each stopping block 184 will deviate in cooling, resulting in inaccuracy of subsequent mounting and matching, and increasing the defective rate of the electrical connector 100. Thus, providing the front hollow slots 191 and the rear hollow slots 192 is conducive to ensuring the accuracy of the insulating body 1, and providing the qualified rate of the electrical connector 100.

Referring to FIG. 1, FIG. 2 and FIG. 3, the electrical connector 100 further includes three functional modules M and a power module E. Each functional module M is inserted forward from a rear thereof into one of the functional accommodating slots 18*s*, and the power module E is inserted forward from a rear thereof into the power accommodating slot 18*p*.

Referring to FIG. 1, FIG. 2 and FIG. 3, the power module E includes a fixing block 4, the two first power terminals 2P and the two second power terminals 3P. The two first power terminals 2P are side-by-side inserted in and fixed to the fixing block 4 along the left-right direction Y, and the two second power terminals 3P are side-by-side inserted in and fixed to a front surface of the fixing block 4 along the left-right direction Y. Each first power terminal 2P has a first bridging portion 2P1 horizontally extending along the front-rear direction X, four first cantilevers 2P2 extending forward from a front end of the first bridging portion 2P1, and three first fixing legs 2P3 bending downward and extending vertically from a rear end of the first bridging portion 2P1. The two bridging portions 2P1 are both fixed to the first side wall 1A of the power insertion slot 104. The four first cantilevers 2P2 of each first power terminal 2P are arranged in a row along the left-right direction Y and provided on the first side wall 1A, and a portion of each first cantilever 2P2 protrudes into the power insertion slot 104 from the first side surface 101. The four first cantilevers 2P2 of each first power terminal 2P are electrically connected to the first power contacts 7P. Each first fixing leg 2P3 is inserted in and fixed to the fixing block 4 and extends downward out of the lower surface of the fixing block 4, passing through the downward opening of the power accommodating slot 18*p* to be electrically soldered and fixed to the circuit board (not shown). Each second power terminal 3P has a second bridging portion 3P1 horizontally extending along the front-rear direction X, and four second cantilevers 3P2 extending forward from a front end of the second bridging portion 3P1. Each second cantilever 3P2 is provided on the second side wall 1B, and portions of the four second cantilevers 3P2 of each second power terminal 3P protrude into the power insertion slot 104 from the second side surface 102. The four second cantilevers 3P2 of each second power terminal 3P are electrically connected to one of the second power contacts (not shown). Three second fixing legs 3P3 bend downward and extend vertically from a rear end of the second bridging portion 3P1. Each second fixing leg 3P3 is provided fixedly through the clamping of the insulating body 1 and the fixing block 4. Each second fixing leg 3P3 extends downward out of a lower surface of the fixing block 4, passing through the downward opening of the power accommodating slot 18*p* to be electrically soldered and fixed to the circuit board (not shown). Each first bridging portion 2P1 and each second bridging portion 3P1 are opposite to each other vertically and one-to-one corresponding to each other. Each first cantilever 2P2 and each second cantilever 3P2 one-to-one correspond to each other in the vertical direction Z. Each first fixing leg 2P3 and each second fixing leg 3P3 one-to-one correspond to each other in the front-rear direction X, and each first fixing leg 2P3 is located behind each second fixing leg 3P3.

Figure 4:
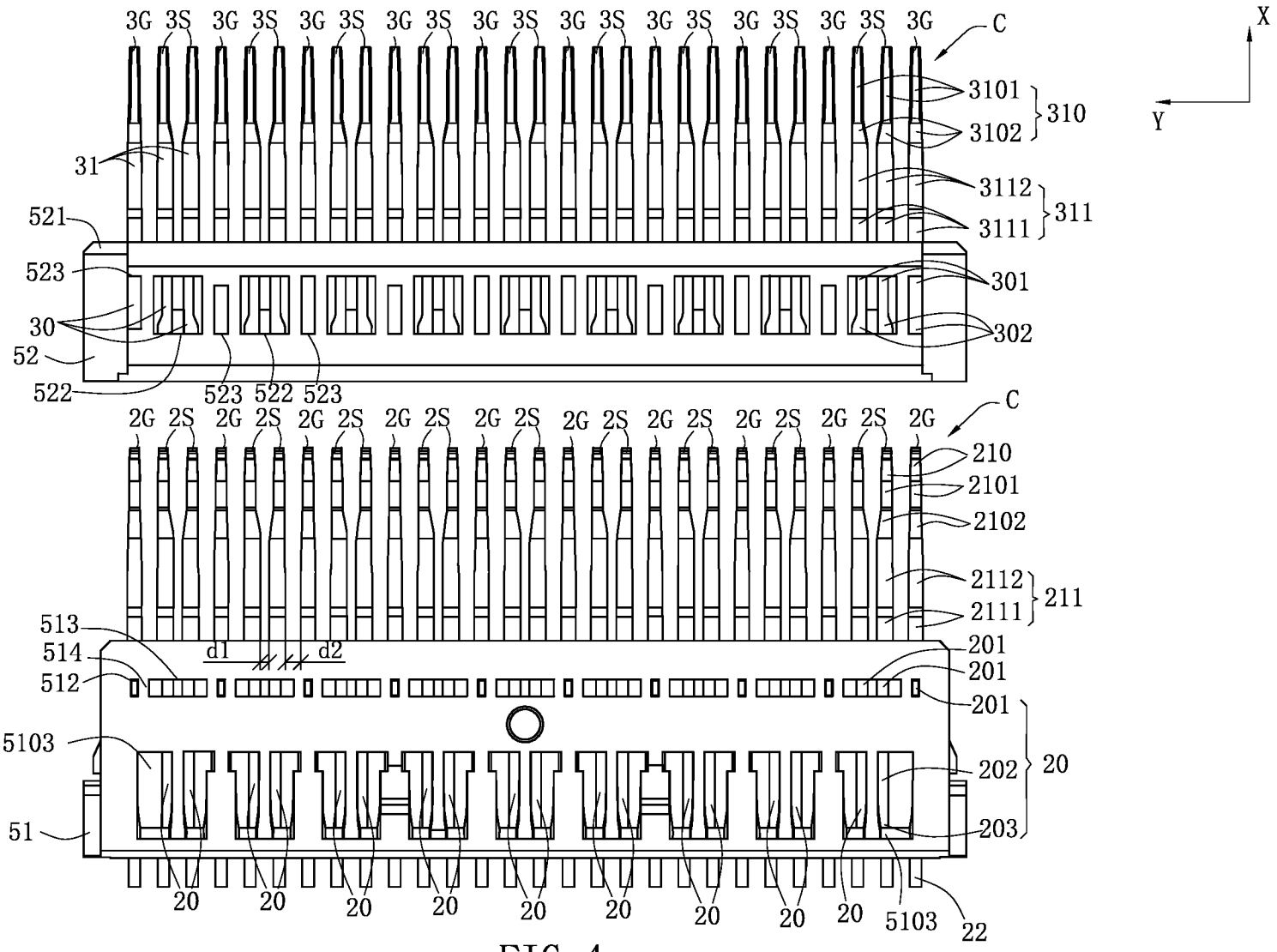
FIG. 4 is a top view of one of the functional module of an electrical connector according to certain embodiments of the present invention.
Figure 5:
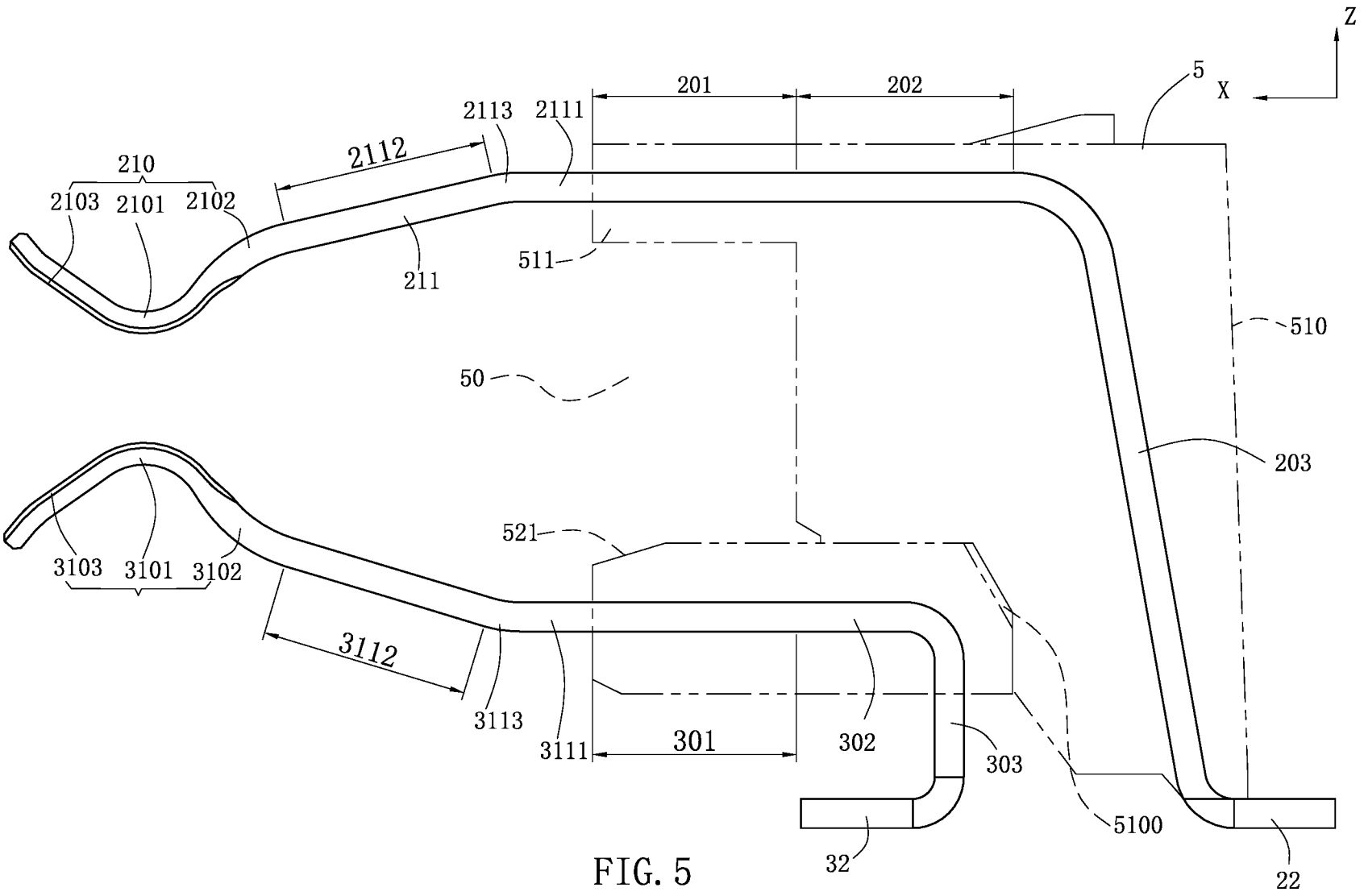
FIG. 5 is a side view of a first terminal and a second terminals of an electrical connector according to certain embodiments of the present invention.

Referring to FIG. 1, FIG. 4 and FIG. 5, each functional module M has an insulating block 5, a plurality of first terminals 2 and a plurality of second terminals 3. The insulating block 5 includes a first insulating block 51 and a second insulating block 52 stacked vertically. The first insulating block 51 and the first terminals 2 arranged in a row along the left-right direction Y are integrally injection-molded, and the second insulating block 52 and the second terminals 3 arranged in a row along the left-right direction Y are integrally injection-molded. The row of the first terminals 2 and the row of the second terminals 3 are provided to be one-to-one opposite to each other along the vertical direction Z and the front-rear direction X. Each row of the first terminals 2 are formed by a plurality of pairs of first signal terminals 2S and a plurality of first ground terminals 2G arranged alternately at intervals. Each pair of the first signal terminals 2S are used to transmit differential high frequency signals and are electrically connected to each pair of the first signal contacts 7S. Each of a left side and a right side of each pair of the first signal terminals 2S has one of the first ground terminals 2G for shielding effect. Each first ground terminal 2G and each first ground contact 7G are electrically connected. Each row of the second terminals 3 are formed by a plurality of pairs of second signal terminals 3S and a plurality of second ground terminals 3G arranged alternately at intervals. Each pair of the second signal terminals 3S are used to transmit differential high frequency signals and are electrically connected to each pair of the second signal contacts. Each of a left side and a right side of each pair of the second signal terminals 3S has one of the second ground terminals 3G for shielding effect. Each second ground terminal 3G and each second ground contact are electrically connected. Each pair of the first signal terminals 2S and each pair of the second signal terminals 3S correspond to each other, and each first ground terminal 2G and each second ground terminal 3G correspond to each other.

Referring to FIG. 3 and FIG. 17, each of a left side and a right side of the first insulating block 51 and the second insulating block 52 is provided with a positioning block T. When the functional modules M is mounted into the insulating body 1, the positioning blocks T on the second insulating block 52 are firstly aligned to the positioning slots 185, and then pushed forward. After the second insulating block 52 is assembled into the accommodating slot 18, the positioning blocks T on the first insulating block 51 are then aligned to the positioning slots 185, and the first insulating block 51 is lastly pushed forward, such that the first insulating block 51 is accommodated in the accommodating slot 18 and located above the second insulating block 52. The positioning blocks T of the first insulating block 51 forward abut the positioning blocks T of the second insulating block 52, thereby allowing the first insulating block 51 and the second insulating block 52 to be altogether in contact with the positioning plain surface 1851 of the positioning slots 185, such that the positioning base surface of the first insulating block 51 and the second insulating block 52 are the same, which is conducive to stable structure and mounting convenience after the first insulating block 51 and the second insulating block 52 are assembled to the insulating body 1. The first insulating block 51 and the second insulating block 52 share the positioning slots 185, simplifying the manufacturing process of the insulating body 1 and saving the cost.

Figure 9:
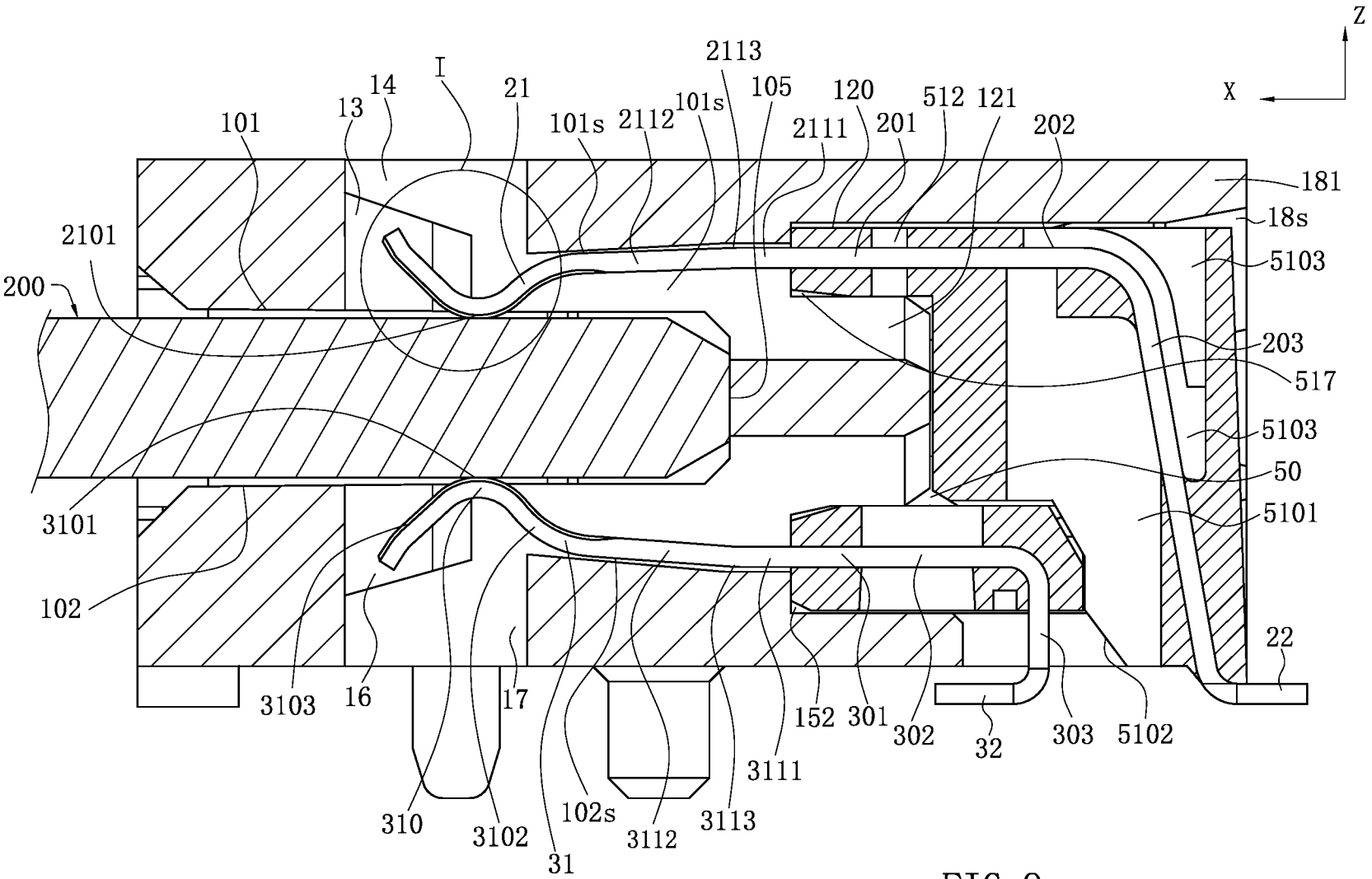
FIG. 9 is a plain sectional view of the electrical connector of FIG. 6 after mating with an electronic card.

Referring to FIG. 5, FIG. 6 and FIG. 9, each first terminal 2 has a first fixing portion 20, a first elastic portion 21 extending forward from a front end of the first fixing portion 20, and a first tail portion 22 bending backward and extending in parallel from a rear end of the first fixing portion 20. The first fixing portion 20 and the first insulating block 51 are integrally injection-molded, such that the first terminal 2 is embedded in and fixed to the first insulating block 51. The first elastic portion 21 is accommodated in the first side wall 1A and is provided to hang in the air in the first side wall 1A, and electrically abuts an upper plate surface of the electronic card 200. Due to the acting force from the electronic card 200, the first elastic portion 21 may elastically deform upward and outward. The first tail portion 22 is exposed on the lower surface of the first insulating block 51 and extends out of the lower opening of the functional accommodating slot 18*s* to be soldered and fixed to the surface of the circuit board (not shown), thereby fixing the first terminal 2 to the circuit board (not shown), facilitating the signal transmission of the electronic card 200 and the circuit board (not shown). Each second terminal 3 has a second fixing portion 30, a second elastic portion 31 extending forward from the second fixing portion 30, and a second tail portion 32 bending forward and extending from a rear end of the second fixing portion 30. The second fixing portion 30 and the second insulating block 52 are integrally injection-molded, such that the second terminal 3 is embedded in and fixed to the second insulating block 52. The second elastic portion 31 is accommodated and hangs in the air in the second side wall 1B, and electrically abuts a lower plate surface of the electronic card 200. Due to the acting force from the electronic card 200, the second elastic portion 31 may elastically deform downward and outward. The second tail portion 32 is exposed on the lower surface of the second insulating block 52 and extends out of the lower opening of the functional accommodating slot 18*s* to be soldered and fixed to the surface of the circuit board (not shown).

Referring to FIG. 2, FIG. 5 and FIG. 6, each first insulating block 51 and each second insulating block 52 are provided longitudinally along the left-right direction Y. The first insulating block 51 has a main body 510, a first protruding block 511 extending forward from an upper end of a front surface of the main body 510, and an empty slot 5100 concavely provided and opening downward on a lower end of the front surface of the main body 510. The second insulating block 52 is provided to be rectangular. A rear end of the second insulating block 52 is accommodated in the empty slot 5100. A front end of the second insulating block 52 protrudes relative to the front surface of the main body 510, thereby forming a second protruding block 521 vertically corresponding to the first protruding block 511. A thickness of the second protruding block 521 is greater than a thickness of the first protruding block 511. An inner side surface of the first protruding block 511, an inner side surface of the second protruding block 521 and the front surface located on the main body 510 altogether form an accommodating space 50.

Figure 16:
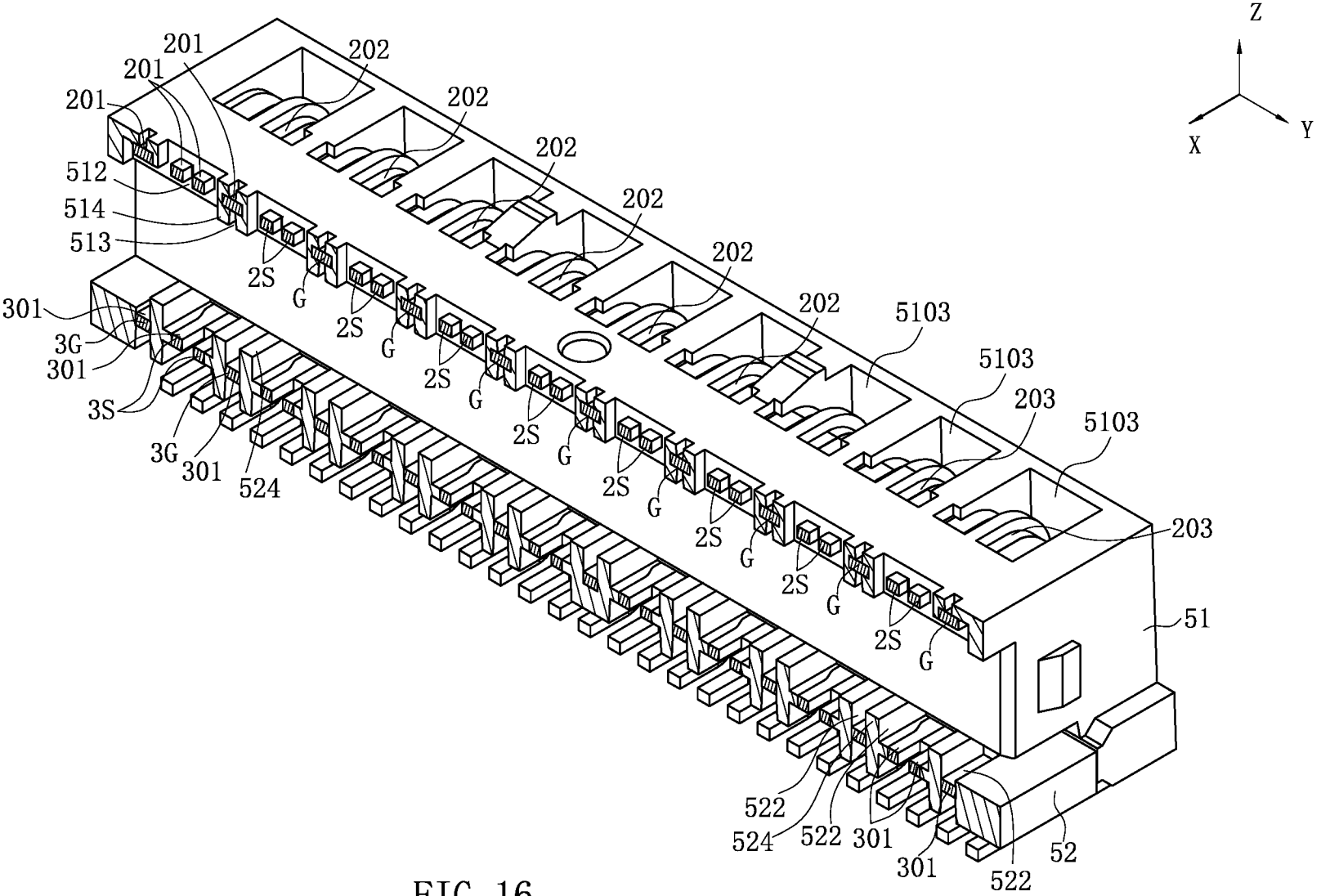
FIG. 16 is a perspective sectional view of the functional modules in FIG. 6 sectioned along line D-D.

Referring to FIG. 5, FIG. 6 and FIG. 16, each first fixing portion 20 has a first cushion portion 201 extending horizontally and embedded in the first protruding block 511. A front end of the first cushion portion 201 is connected forward to the first elastic portion 21. A first horizontal portion 202 extends horizontally backward from a rear end of the first cushion portion 201, and a first extending portion 203 is formed by bending downward and extending from the first horizontal portion 202. The first extending portion 203 obliquely extends downward and backward to the lower surface of the main body 510. The first tail portion 22 bends backward and extends from the lower end of the first extending portion 203. Each second fixing portion 30 has a second cushion portion 301 extending horizontally. A front end of the second cushion portion 301 is connected forward to the corresponding second elastic portion 31. A second horizontal portion 302 extends horizontally backward from a rear end of the second cushion portion 301, and a second extending portion 303 is formed by extending downward from the second horizontal portion 302. The second extending portion 303 extends vertically downward to the lower surface of the second insulating block 52. The second tail portion 32 bends forward and extends from the lower end of the second extending portion 303. Each first cushion portion 201 and the second cushion portion 301 are opposite to each other vertically. The first horizontal portion 202 and the second horizontal portion 302 are opposite to each other vertically. Each first extending portion 203 and each second extending portion 303 are provided to be opposite to each other along the front-rear direction X, and the second extending portion 303 is located in front of the corresponding first extending portion 203.

Referring to FIG. 5, FIG. 6 and FIG. 15, the first cushion portion 201 of each first signal terminal 2S defines a width P3 along the left-right direction Y, the first cushion portion 201 of each first ground terminal 2G defines a width P4 along the left-right direction Y, and the width P3 is less than the width P4. The second cushion portion 301 of each second signal terminal 3G defines a width P5 along the left-right direction Y, the second cushion portion 301 of each second ground terminal 3G defines a width P6 along the left-right direction Y, and the width P5 is less than the width P6. The width P5 is less than the width P3 and the width P6 is less than the width P4.

Referring to FIG. 6, FIG. 15 and FIG. 16, an inner side surface of each first protruding block 511 is upward concavely provided with a plurality of first holes 512 and a plurality of second holes 513, provided alternately at intervals along the left-right direction Y. A first abutting rib 514 is formed between each adjacent first hole 512 and the second hole 513 and defined on the first protruding block 511. The two first cushion portions 201 of a pair of the first signal terminals 2S are defined as a pair of the first cushion portions 201, and the pair of the first cushion portions 201 are exposed in the first hole 512. The first holes 512 extend continuously along the left-right direction Y and the vertical direction Z, such that the upper surface, the lower surface, the left side surface and the right side surface of each first cushion portion 201 are all exposed in the air, thereby adjusting the impedance of the pair of the first cushion portions 201, increasing the air content around the pair of the first cushion portions 201, reducing the dielectric coefficient around the pair of the first cushion portions 201, decreasing the impedance of the pair of the first cushion portions 201, and providing good impedance balance effect between the first elastic portion 21 and the first horizontal portion 202. In each first ground terminal 2G, the left side surface and the right side surface of the first cushion portion 201 are both embedded in the two first abutting ribs 514, and the upper surface and the lower surface of the first cushion portion 201 are both exposed in the second hole 513. A portion of the second hole 513 located above the first cushion portion 201 forms a trumpet shape opening upward, and a portion of the second hole 513 located below the first cushion portion 201 forms a trumpet shape opening downward. In the process of injection-molding the first terminals 2 and the first insulating block 51, an upper mold and a lower mold matching each other fix the first cushion portion 201 of the first ground terminal 2G vertically through the second hole 513. After the injection-molding is complete, the second hole 513 in the form of the trumpet shape opening upward is convenient for the upper mold to detach upward, and the second hole 513 in the form of the trumpet shape opening downward is convenient for the lower mold to detach downward.

Referring to FIG. 6, FIG. 8 and FIG. 13, the lower surface of the main body 510 is upward concavely provided with a plurality of first exposing holes 5101. The inner surfaces of each two adjacent first fixing portion 20 are exposed in one of the first exposing holes 5101. That is, the lower surfaces of the two adjacent horizontal portions 202 and the two opposite first extending portions 203 are exposed in the first exposing hole 5101. A third abutting rib 5102 is formed between each two adjacent first exposing holes 5101. Each third abutting rib 5102 extends vertically along the front-rear direction X and the vertical direction Z. Each third abutting rib 5102 upward abuts the lower surface of each horizontal portion 202 and backward abuts the front surface of each first extending portion 203. The upper surface of the main body 510 is downward concavely provided with a plurality of second exposing holes 5103, and the second exposing holes 5103 extend in the front-rear direction X and the vertical direction Z. A portion of each second exposing hole 5103 extending vertically forms a shape with its width shrinking downward from a top thereof. One of the second exposing holes 5103 exposes the upper surfaces of a pair of the horizontal portions 202 and rear surfaces of a pair of the first extending portions 203 of a pair of the first signal terminals 2S.

Referring to FIG. 6, FIG. 8 and FIG. 13, in the process of integrally injection-molding the first insulating block 51 and the first fixing portions 20, the lower mold is inserted upward into each first exposing hole 5101 to upward abut and fix the lower surface of each first horizontal portion 202 and the front surface of each first extending portion 203. The upper mold is inserted downward into each second exposing hole 5103 to downward abut and fix the upper surfaces of a pair of the first horizontal portions 202 and to forward abut the rear surfaces of a pair of the first extending portions 203. The upper mold and the lower mold match vertically, thereby fixing the first horizontal portions 202 fixedly corresponding in the vertical direction Z and the first extending portions 203 fixedly corresponding in the front-rear direction X. The first extending portions 203 obliquely extend downward from a top thereof, such that each of the first exposing holes 5101 and the second exposing holes 5103 has an inner wall obliquely provided along the vertical direction Z, thereby allowing the lower mold to conveniently detach downward from the first exposing holes 5101, and the upper mold to conveniently detach upward from the second exposing holes 5103.

Referring to FIG. 4, FIG. 6 and FIG. 15, the second insulating block 52 is accommodated backward in the empty slot 5100. Each third abutting rib 5102 downward abuts the rear end of the upper surface of the second insulating block 52 and forward abuts the rear surface of the second insulating block 52. The inner side surface of each second protruding block 521 is downward concavely provided with a plurality of third holes 522 and a plurality of fourth holes 523. The third holes 522 and the fourth holes 523 are provided alternately along the left-right direction Y. The two second cushion portions 301 of a pair of the second signal terminals 3S are defined as a pair of the second cushion portions 301. Each pair of the second cushion portions 301 are exposed in each third hole 522, and the third holes 522 extend continuously along the left-right direction Y and the vertical direction Z. A left side surface, a right side surface, an upper surface and a lower surface of each second cushion portion 301 of a pair of the second cushion portion 301 are all exposed in the third hole 522, thereby being conducive to adjusting the impedance of the pair of the second cushion portions 301, reducing the dielectric coefficient around the pair of the second cushion portions 301, and further decreasing the impedance of the pair of the second cushion portions 301, such that good impedance balance effect exists between the second elastic portion 31 and the second horizontal portion 302.

Referring to FIG. 4, FIG. 6 and FIG. 15, in a pair of the second signal terminals 3S, the two second horizontal portions 302 are defined as a pair of the second horizontal portions 302 and a pair of the second extending portion 303. A front end of each second horizontal portion 302 of the pair of the second horizontal portions 302 is connected forward to the corresponding second cushion portion 301, and the third hole 522 extends backward to pass beyond the front surface of the main body 510. The front ends of the pair of the second horizontal portions 302 are exposed in a third hole 522, thereby adjusting the impedance of the pair of the second horizontal portions 302. The rear ends of the pair of the second horizontal portions 302 are embedded in the rear end of the second insulating block 52, which is conducive to fixing the second terminals 3. Each second extending portion 303 corresponds backward to a first extending portion 203, and a distance between the two is provided to increase downward from a top thereof, which is conducive to providing sufficient space between the first tail portion 22 and the second tail portion 32 to be fixed and soldered to the circuit board (not shown). Each first tail portion 22 and each second tail portion 32 are located on a same horizontal plane, thereby being conducive to being soldered and fixed to the circuit board (not shown).

Referring to FIG. 9, FIG. 13 and FIG. 15, each first functional module M is inserted forward into a corresponding functional accommodating slot 18*s*. The first protruding block 511 extends and is accommodated in each first slot 120 of a row of the first separation ribs and abuts the inner wall of each first slot 120. Each first portion 121 of the row of the first separation ribs is backward accommodated in the accommodating space 50, and upward abuts the inner side surface of the first protruding block 511. The first protruding block 511 has a plurality of guiding slots 517. Each guiding slot 517 is concavely provided on the front surface of the first protruding block 11 and the inner side surface of the first protruding block 11. Each guiding slot 517 is used to guide each first portion 121 to move backward into the accommodating space 50. A left inner wall and a right inner wall of each guiding slot 517 are used to guide the moving trajectory of the first portion 121 in the left-right direction Y to move backward into the accommodating space 50. Each first abutting rib 514 and each first portion 121 abut vertically, and two adjacent first portions 121 and the inner side surface of the first protruding block 511 form an air slot. The inner sides of each pair of the first cushion portions 201 has an air slot, defined as a first air slot 515. The inner side of the first cushion portion 201 of one of the first ground terminals 2G has an air slot, defined as a second air slot 516. The first air slot 515 and the second air slot 516 are separated by a first portion 121. The first hole 512 is communicated downward to the first air slot 515, increasing the air content around the pair of the first cushion portions 201, thereby being conducive to reducing the impedance of the pair of the first cushion portion 201, and facilitating high frequency characteristics. The two side walls of the first hole 512 in the left-right direction Y are provided to be outer relative to the two side walls of the first air slot 515 along the left-right direction Y, such that the two side walls of the first hole 512 and the two side walls of the first air slot 515 respectively form step shapes, increasing the air content of the first hole 512 and the first air slot 515, thereby being conducive to reducing the impedance of the pair of the first cushion portion 201 and suppressing the temperature increase of the pair of the first cushion portion 201. Since an extending length of the first fixing portion 20 is relatively long and the area thereof embedded by the first insulating block 51 is relatively large, if the impedance of the pair of the first cushion portions 201 is smaller, when the high frequency signals are transmitted from the first elastic portion 21 to the first cushion portion 201, the attenuation of the high frequency signals at the first cushion portion 201 is smaller, further ensuring more high frequency signals to be transmitted to the first horizontal portion 202 and the first extending portion 203. The second hole 513 is communicated upward to the second air slot 516, and the two side walls of the second hole 513 along the left-right direction Y shrink inward relative to the two side walls of the second air slot 516 along the left-right direction Y. The first cushion portion 201 of the first ground terminal 2G is communicated to the second air slot 516, such that more air is in contact with the first cushion portion 201 of the first ground terminal 2G, thereby stopping the first cushion portion 201 of the first ground terminal C from an excessive temperature increase, such that the temperature difference between the first cushion portion 201 and the first elastic portion 21 of the first ground terminal 2G is not excessive, and thereby cushioning and balancing the overall temperature difference of the first ground terminal 2G.

Referring to FIG. 13, FIG. 15 and FIG. 16, the front surface of each second protruding block 521 has a backward chamfer to guide the second protruding block 521 to be inserted forward into each second slot 152 of a row of the second separation walls 15. Each second portion 151 is accommodated backward in the accommodating space 50 and downward abuts the inner side surface of the second protruding block 521, and each second portion 151 correspondingly abuts each second abutting rib 524. Each two adjacent second portions 151 and the inner side surface of the second protruding block 521 form an air slot. The inner sides of each pair of the second cushion portions 301 has an air slot, defined as a third air slot 525. The inner side of the second cushion portion 301 of each second ground terminal 3G has an air slot, defined as a fourth air slot 526. The third hole 522 is communicated upward to the third air slot 525, and the pair of the second cushion portions 301 exposed in the third hole 522 and the third air slot 525 are communicated, thereby increasing the air content around the pair of the second cushion portions 301, reducing the dielectric coefficient around the pair of the second cushion portions 301, and reducing the impedance of the pair of the second cushion portion 301. The fourth hole 523 is communicated upward to the fourth air slot 526.

Referring to FIG. 4, FIG. 6 and FIG. 14, each first elastic portion 21 of the row of first terminals 2 is accommodated in the first side wall 1A. The two first elastic portions 21 of a pair of the first signal terminals 2S are defined as a pair of the first elastic portions 21. The pair of the first elastic portions 21 are accommodated in each first signal slot 101*s*, and the first elastic portion 21 of each first ground terminal 2G is accommodated in each first ground slot 101*g*. Each first elastic portion 21 of the row of the first terminals 2 has a first connecting portion 211 and a first contact portion 210 extending forward from the first connecting portion 211. The two first contact portions 210 and the two first connecting portions 211 of the pair of the first signal terminals 2S are defined as a pair of the first contact portions 210 and a pair of the first connecting portions 211. A first distance d1 is defined between the pair of the first connecting portions 211 along the left-right direction Y, and the first distance d1 maintains equal backward from a front thereof. A distance between the first connecting portion 211 of the first ground terminal 2G and the first connecting portion 211 of its adjacent first signal terminal 2S along the left-right direction Y is provided to be unequal backward from a front thereof.

Figure 7:
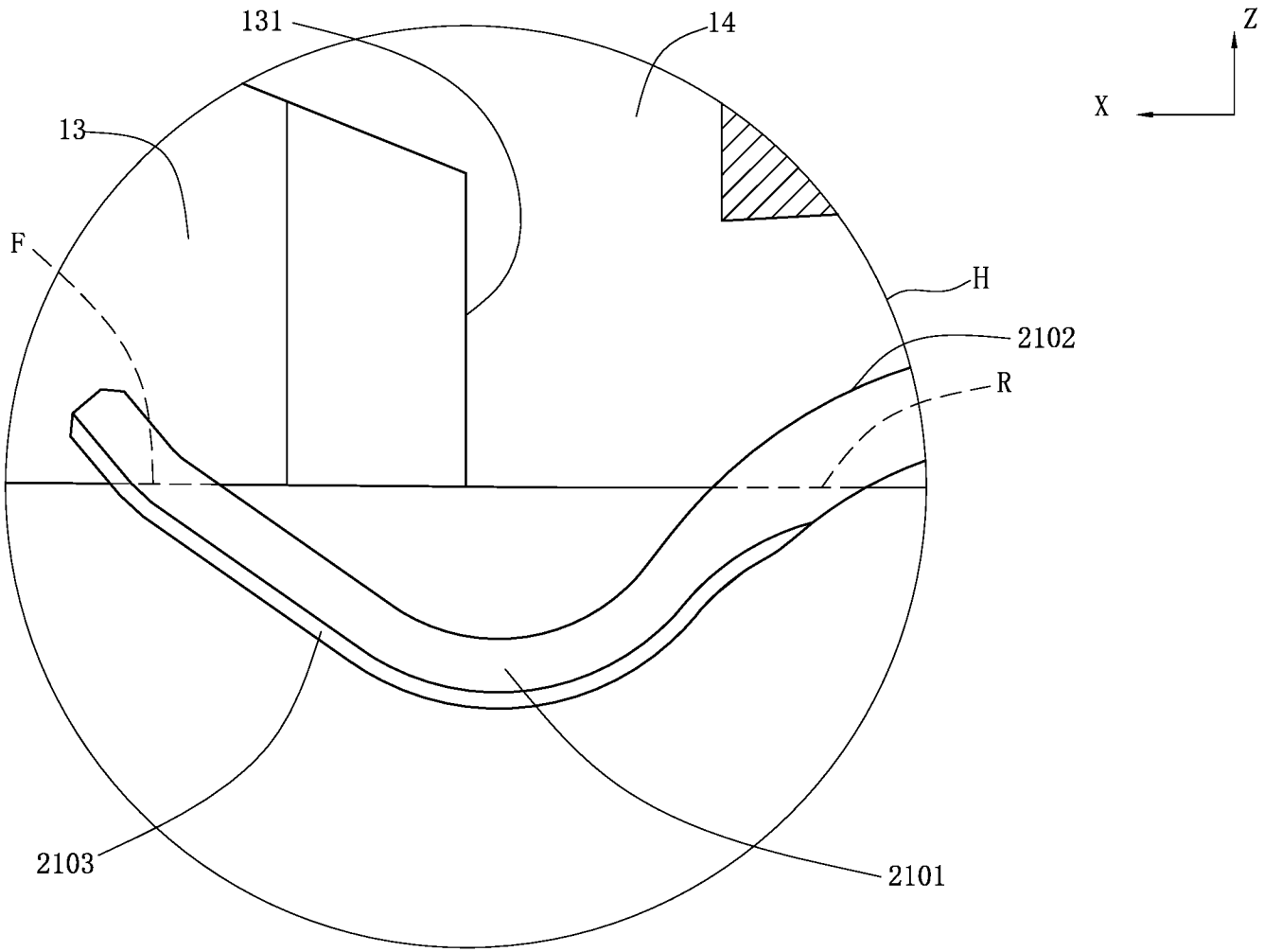
FIG. 7 is a partial enlarged view of FIG. 6.
Figure 10:
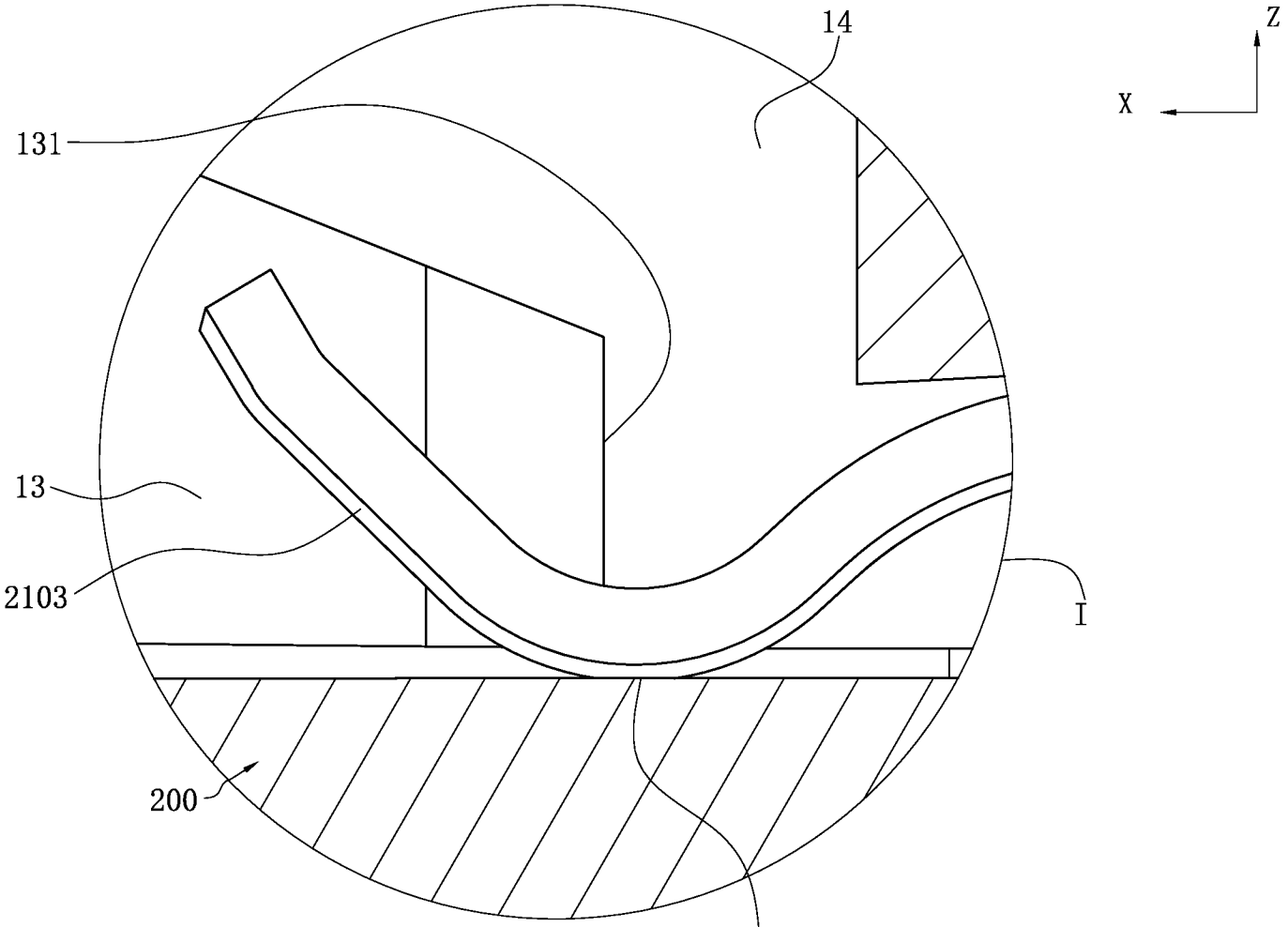
FIG. 10 is a partial enlarged view of FIG. 9.

Referring to FIG. 6 and FIG. 7, each first contact portion 210 forms an arc shape arched downward and is used to be electrically connected to each first contact 7. A pitch of each two first contact portions 210 of a row of the first terminals 2 is provided to be equal. When the electronic card 200 has not been inserted into the insertion slot 10, the first elastic portion 21 is in a free state, and the first contact portion 210 is provided to be protruding relative to the first side surface 101. The first contact portion 210 and a projection of the first side surface 101 along the left-right direction Y virtually form a front intersection line F and a rear intersection line R, each first rib 13 is located between each pair of the first contact portions 210, and the free end 131 of the first rib 13 passes backward beyond the front intersection line F and does not pass backward beyond the rear intersection line R. Referring to FIG. 9 and FIG. 10, in the process of the electronic card 200 being inserted into the insertion slot 10, a portion of each first contact portion 210 of the pair of the first contact portions 210 protruding out of the first side surface 101 moves backward to be inside the first side wall 1A, and the pair of the first contact portions 210 are provided to be separated by the first rib 13. The free end 131 of the first rib 13 extends backward to pass beyond the front intersection line F, ensuring the pair of the first contact portions 210 to always be separated by the first rib 13 in the process of moving outward, and preventing the pair of the first contact portions 210 from mistakenly touching each other due to elastic deformation and causing short-circuiting. The free end 131 of the first rib 13 does not pass backward beyond the rear intersection line R, such that the air content of the medium between the pair of the first elastic portions 21 increases, thereby reducing the dielectric coefficient between the pair of the first elastic portions 21, which is conducive to high frequency signal transmission.

Referring to FIG. 4, FIG. 5 and FIG. 12, each first contact portion 210 has a first abutting portion 2101. Each first abutting portion 2101 protrudes inward into the functional insertion slot 103 and is electrically connected to each first contact 7. A first transition portion 2102 extends backward from the first abutting portion 2101, and the first transition portion 2102 is connected backward to the first connecting portion 211. The two first abutting portions 2101 and the two first transition portions 2102 of a pair of the first signal terminals 2S are defined as a pair of the first abutting portions 2101 and a pair of the first transition portions 2102. A distance between two opposite inner edges of each pair of the first abutting portions 2101 defined along the left-right direction Y maintains equal backward from a front thereof, and a distance between two opposite inner edges of each pair of the first transition portions 2102 is provided to reduce backward from a front thereof. The two opposite inner edges of each pair of the first transition portions 2102 form a trumpet shape shrinking backward, reducing the distance between the pair of the first contact portions 210, and increasing the high frequency signal coupling between the pair of the first contact portions 210, which is conducive to high frequency signal transmission. The free end 131 of the first rib 13 is located between the pair of the first abutting portions 2101, and there is no first rib 13 between the pair of the first transition portions 2102, which are separated only by air, thereby adjusting the impedance of the pair of the first elastic portions 21.

Referring to FIG. 8, FIG. 9 and FIG. 10, each first window 14 exposes each pair of the first abutting portion 2101. When the functional insertion portion 8C is inserted into the functional insertion slot 103, each pair of the first abutting portions 2101 are abutted by the functional insertion portion 8C to deform outward. Viewing each first window 14 downward from a top thereof, each pair of the first abutting portions 2101 are located at two sides of a corresponding first rib 13, and the process of elastically deforming outward is exposed in each first window 14. When an accident occurs, e.g., a "buckling" effect occurs at the first contact portion 210 (that is, the first abutting portion 2101 is pressed and crushed by the electronic card 200), it is observable through the first window 14. Meanwhile, each first window 14 is communicated with the air in the outer environment, increasing the air around the pair of the first abutting portions 2101, such that the dielectric coefficient around the first abutting portion 2101 is reduced, thereby reducing the attenuation of the high frequency signal at the pair of the first abutting portions 2101. The outer side of each first abutting portion 2101 of each first ground terminal 2G is covered by the first side wall 1A, thereby increasing the dielectric coefficient around each first abutting portion 2101 of each first ground terminal 2G, reducing the energy loss of the capacitance effect between the first abutting portion 2101 of the first ground terminal 2G and the first abutting portion 2101 of the first signal terminal 2S, thereby allowing more high frequency signal energy to transmit at the pair of the first abutting portions 2101 of the pair of the first signal terminals 2S.

Referring to FIG. 6 and FIG. 12, each of two sides of the inner surface of each first contact portion 210 has a first guiding corner 2103. The extending paths of the two first guiding corners 2103 extending the first contact portion 210 are respectively located at the two sides of the first abutting portion 2101. Referring to FIG. 9 and FIG. 10, the first guiding corner 2103 guides the contact portion 210 to partially pass the corresponding first rib 13 and to protrude into the insertion slot 10.

Referring to FIG. 4 and FIG. 6, the first connecting portion 211 extends forward from the front surface of the first protruding block 511, and the first contact portion 210 extends forward from the first connecting portion 211. A rear end of the first connecting portion 211 has a first adjusting portion 2111 extending horizontally and a first oblique portion 2112 extending obliquely downward and forward. The first connecting portion 211 has a first bending portion 2113 bending downward, and the first bending portion 2113 connects the first oblique portion 2112 and the first adjusting portion 2111 in the front-rear direction. Each first adjusting portion 2111 extends forward from the first cushion portion 201, and a critical surface of the first adjusting portion 2111 and the first cushion portion 201 is the front surface of the first protruding block 511. The first bending portion 2113 and the bottom surface 105 are located on the same vertical plane, ensuring that the first adjusting portion 2111 has a sufficient length in the front-rear direction X to adjust the impedance. The first oblique portion 2112 extends straightly to the first contact portion 210, such that the high frequency signal transmission is transmitted through a shorter path, reducing its attenuation.

Referring to FIG. 5, FIG. 6 and FIG. 9, each first adjusting portion 2111 of a row of the first terminals 2 extends forward and does not pass beyond the bottom surface 105. When the electronic card 200 is inserted into the functional insertion slot 103, a pair of the first signal contacts 7S and a pair of the first abutting portions 2101 are electrically connected, and the high frequency signal is transmitted from the first signal contact 7S to the first abutting portion 2101, and is then transmitted to the first transition portion 2102, and then passes backward from a front thereof through the first transition portion 2102, the first oblique portion 2112, the first adjusting portion 2111, the first cushion portion 201, the first horizontal portion 202, the first extending portion 203, the first tail portion 22, and is then transmitted to the circuit board (not shown). The two first adjusting portions 2111 of the pair of the first signal terminals 2S define a pair of the first adjusting portions 2111. The pair of the first adjusting portions 2111 do not pass forward beyond the bottom surface 105, such that a distance between the pair of the first adjusting portions 2111 and the pair of the first signal contacts 7S is relatively farther, thereby preventing the interference magnetic wave of the pair of the first signal contacts 7S from affecting the high frequency signals of the pair of the first adjusting portions 2111, such that the high frequency signals may transmit well from the pair of the first adjusting portions 2111 to the pair of the first cushion portions 201.

Referring to FIG. 11, FIG. 12 and FIG. 14, no first separation wall 12 exists between a pair of the first connecting portion 211, and the medium therebetween is only air. That is, the medium between a pair of the first oblique portions 2112, the medium between a pair of the first bending portions 2113 and the medium between a pair of the first adjusting portions 2111 are all air, and are not separated by the first separation walls 12. The first distance d1 between the pair of the first connecting portions 211 are provided to be equal backward from a front thereof. That is, each of the distances between the pair of the first oblique portions 2112, between the pair of the first bending portions 2113 and between the pair of the first adjusting portions 2111 along the left-right direction Y is the first distance d1. Meanwhile, a second distance d2 is defined between the first adjusting portion 211 of the first ground terminal 2G and the first adjusting portion 211 of its adjacent first signal terminal 2S along the left-right direction Y, and the second distance d2 maintains equal backward from a front thereof. The second distance d2 is larger than the first width W1, and the first width W1 is larger than the first distance d1, such that high frequency signal coupling of each location of the pair of the first signal terminals 2S backward from a front thereof is good. Further, the first distance d1 and the second distance d2 maintain equal backward from the front thereof, such that the high frequency signals may achieve more coupling through the pair of the first signal terminals 2S. Meanwhile, referring to FIG. 6, FIG. 14 and FIG. 15, the first adjusting portion 2111 of each first signal terminal 2S defines a width P1 along the left-right direction Y, and the first adjusting portion 2111 of each first ground terminal 2G defines a width P2 along the left-right direction Y. The width P1 is greater than the width P2, increasing the capacitance of the pair of the first adjusting portions 2111, thereby reducing the impedance of the pair of the first adjusting portions 2111, which is conducive to high frequency characteristics. Meanwhile, the width P3 of the first cushion portion 201 of the first signal terminal 2S is less than the width P4 of the first cushion portion 201 of the first ground terminal 2G, thereby suppressing the change of the impedance. In each first signal terminal 2S, the width P1 of the first adjusting portion 2111 is greater than the width P3 of the first cushion portion 201. In each first ground terminal 2G, the width P2 of the first adjusting portion 2111 is less than the width P4 of the first cushion portion 201, thereby adjusting the impedance of the terminals C.

Referring to FIG. 4 and FIG. 5, a distance between the first oblique portion 2111 of the first ground terminal 2G and the first oblique portion 2111 of its adjacent first signal terminal 2S is provided to be unequal backward from a front thereof, but is always greater than or equal to the second distance d2 backward from the front thereof, such that the high frequency signal coupling between the pair of the first oblique portions 2112 is better, which is conducive to preventing the signal transmission from being interfered. Meanwhile, a width of a rear end of each first oblique portion 2112 of a pair of the first oblique portions 2112 is increased relative to a width of its front end, thereby reducing the impedance of the pair of the first oblique portions 2112.

Referring to FIG. 4, FIG. 6 and FIG. 13, each second elastic portion 31 of a row of the second terminals 3 is provided on the second side wall 1B and is provided to be located on the same row along the left-right direction Y. The row of the second elastic portions 31 and the row of the first elastic portions 21 are opposite to each other vertically. The two second elastic portions 31 of each pair of the second signal terminals 3S are defined as a pair of the second elastic portions 31, and the pair of the second elastic portions 31 are accommodated in each second signal slot 102*s*. Each second elastic portion 31 of each second ground terminal 3G is accommodated in each second ground slot 102*g*. The structure and shape of each second elastic portion 31 are similar to those of each first elastic portion 21. Each second elastic portion 31 has a second contact portion 310 and a second connecting portion 311. Each second elastic portion 31 has a second abutting portion 3101, a second transition portion 3102, a second oblique portion 3112, a second bending portion and a second adjusting portion 3111 backward from a front thereof. The second abutting portion 3101 and the second transition portion 3102 are portions of the second contact portion 310, and the second oblique portion 3112, the second bending portion and the second adjusting portion 3111 are portions of the second connecting portion 311. Each of the portions of the pair of the second signal terminals 3S are defined as a pair thereof.

Referring to FIG. 6, FIG. 8 and FIG. 9, the pair of the second abutting portions 3101 are correspondingly exposed in one of the second windows 17. An end of each second rib 16 is located between each pair of the second abutting portions 3101, and each second rib 16 is exposed in a corresponding second window 17. Two opposite inner edges of each pair of the second transition portions 3102 form a trumpet shape shrinking backward from a front thereof. No second rib 16 exists between each pair of the second transition portions 3102, and the medium therebetween is only air. A distance between each pair of the second oblique portions 3102 along the left-right direction Y maintains equal backward from a front thereof, and a width of a rear end of each second oblique portion 3112 of each pair of the second oblique portions 3112 is relatively increased, reducing the impedance. Each second bending portion, each first bending portion 2113 and the bottom surface 105 pass the same vertical plane. Each second adjusting portion 3111 extends horizontally forward from the second cushion portion 301 and does not pass beyond the bottom surface 105. Each of two sides of the inner surface of each second contact portion 310 has a second guiding corner 3103, which has similar functions to the first guiding corner 2103. The second elastic portion 31 is similar to the structure of the first elastic portion 21, and the second side wall 1B is similar to the structure of the first side wall 1A. Thus, the positional and structural relationships and functions of the second elastic portion 31 and the second side wall 1B may be referred to as the positional and structural relationships and functions of the first elastic portion 21 and the first side wall 1A, and are thus not further elaborated herein.

Referring to FIG. 6, FIG. 8 and FIG. 9, the difference between the second elastic portion 31 and the first elastic portion 21 exists in that, the first elastic portion 21 extends downward, and the second elastic portion 31 extends upward. A height of an arc vertex of the first abutting portion 2101 to the first adjusting portion 2111 along the vertical direction Z is defined as an elastic height of the first elastic portion 21, and a height of an arc vertex of the second abutting portion 3101 to the second adjusting portion 3111 along the vertical direction Z is defined as an elastic height of the second elastic portion 31. Prior to the electronic card 200 being inserted into the insertion slot 10, the elastic height of the first elastic portion 21 is less than the elastic height of the second elastic portion 31, thereby reducing the insertion force of the electronic card 200, allowing the electronic card 200 to be inserted into the insertion slot 10.

In sum, the electrical connector according to certain embodiments of the present invention has the following beneficial effects:

1. Each first adjusting portion 2111 of a row of the first terminals 2 extends forward and does not pass beyond the bottom surface 105. When the electronic card 200 is inserted into the functional insertion slot 103, a pair of the first signal contacts 7S and a pair of the first abutting portions 2101 are electrically connected, and the high frequency signal is transmitted from the first signal contact 7S to the first abutting portion 2101, and is then transmitted to the first transition portion 2102, and then passes backward from a front thereof through the first transition portion 2102, the first oblique portion 2112, the first adjusting portion 2111, the first cushion portion 201, the first horizontal portion 202, the first extending portion 203, the first tail portion 22, and is then transmitted to the circuit board (not shown). The two first adjusting portions 2111 of the pair of the first signal terminals 2S define a pair of the first adjusting portions 2111. The pair of the first adjusting portions 2111 do not pass forward beyond the bottom surface 105, such that a distance between the pair of the first adjusting portions 2111 and the pair of the first signal contacts 7S is relatively farther, thereby preventing the interference magnetic wave of the pair of the first signal contacts 7S from affecting the high frequency signals of the pair of the first adjusting portions 2111, such that the high frequency signals may transmit well from the pair of the first adjusting portions 2111 to the pair of the first cushion portions 201. Further, one of the first ribs 13 exists between the two first contact portions 210 of each pair of the first signal terminals 2S, preventing the first elastic portions of the pair of the first signal terminals 2S to mistakenly touch each other due to elastic deformation and causing short-circuiting. The first rib 13 and the bottom surface 105 are provided at an interval in the front-rear direction, such that the air content between the pair of the first signal terminals 2S increases, thereby reducing the dielectric coefficient between the pair of the first signal terminals 2S, which is conducive to high frequency signal transmission.

2. The second distance d2 is larger than the first width W1, and the first width W1 is larger than the first distance d1, such that high frequency signal coupling of each location of the pair of the first signal terminals 2S backward from a front thereof is good. Further, the first distance d1 and the second distance d2 maintain equal backward from the front thereof, such that the high frequency signals may achieve more coupling through the pair of the first signal terminals 2S. a distance between the first oblique portion 2111 of the first ground terminal 2G and the first oblique portion 2111 of its adjacent first signal terminal 2S is provided to be unequal backward from a front thereof, but is always greater than or equal to the second distance d2 backward from the front thereof, such that the high frequency signal coupling between the pair of the first oblique portions 2112 is better, which is conducive to preventing the signal transmission from being interfered. Meanwhile, a width of a rear end of each first oblique portion 2112 of a pair of the first oblique portions 2112 is increased relative to a width of its front end, thereby reducing the impedance of the pair of the first oblique portions 2112.

3. Each first window 14 exposes each pair of the first abutting portion 2101. When the functional insertion portion 8C is inserted into the functional insertion slot 103, each pair of the first abutting portions 2101 are abutted by the functional insertion portion 8C to deform outward. Viewing each first window 14 downward from a top thereof, each pair of the first abutting portions 2101 are located at two sides of a corresponding first rib 13, and the process of elastically deforming outward is exposed in each first window 14. When an accident occurs, e.g., a "buckling" effect occurs at the first contact portion 210 (that is, the first abutting portion 2101 is pressed and crushed by the electronic card 200), it is observable through the first window 14. Meanwhile, each first window 14 is communicated with the air in the outer environment, increasing the air around the pair of the first abutting portions 2101, such that the dielectric coefficient around the first abutting portion 2101 is reduced, thereby reducing the attenuation of the high frequency signal at the pair of the first abutting portions 2101. The outer side of each first abutting portion 2101 of each first ground terminal 2G is covered by the first side wall 1A, thereby increasing the dielectric coefficient around each first abutting portion 2101 of each first ground terminal 2G, reducing the energy loss of the capacitance effect between the first abutting portion 2101 of the first ground terminal 2G and the first abutting portion 2101 of the first signal terminal 2S, thereby allowing more high frequency signal energy to transmit at the pair of the first abutting portions 2101 of the pair of the first signal terminals 2S.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first component and a second component, the electrical connector comprising:

an insulating body, having an insertion slot concavely provided backward and configured for the first component to insert backward therein along a front-rear direction, wherein a bottom surface is defined behind the insertion slot, the insulating body has a plurality of side walls connected to the bottom surface, the side walls surroundingly form the insertion slot, one of the side walls is defined as a first side wall, the first side wall has a first side surface facing the insertion slot, and the first side wall has a first rib extending backward and having a free end;

a plurality of terminals, having at least one pair of first signal terminals provided at one side of the insertion slot, wherein each of the terminals has a contact portion and a tail portion provided in the front-rear direction, the contact portion is provided relatively in front of the bottom surface and protrudes into the insertion slot to be electrically connected to the first component, the tail portion is electrically connected to the second component, each of the terminals further has a fixing portion and a connecting portion, the fixing portion and the connecting portion are located between the contact portion and the tail portion, the connecting portion is relatively close to the contact portion, and the fixing portion is relatively close to the tail portion;

wherein a first direction is defined to be perpendicular to the front-rear direction, the at least one pair of first signal terminals are arranged along the first direction and provided on the first side wall, the free end of the first rib is located between the two contact portions of one of the at least one pair of first signal terminals, and a portion of each of the contact portions of the terminals provided on the first side wall protrudes inward relative to the first side surface into the insertion slot to be electrically connected to the first component;

wherein prior to the first component inserting into the insertion slot, a projection of the portion of each of the contact portions protruding inward relative to the first side surface along the first direction and a projection of the first side surface along the first direction virtually form a front intersection line and a rear intersection line provided at intervals along the front-rear direction, and the free end of the first rib passes backward beyond the front intersection line and does not pass backward beyond the rear intersection line; and an insulating block, wherein a front surface of the insulating block is provided relatively behind the bottom surface, the fixing portion of each of the terminals is fixed to the insulating block, the connecting portion of each of the terminals extends forward from the front surface of the insulating block and passes beyond the bottom surface, a portion of the connecting portion of each of the terminals not passing forward beyond the bottom surface is defined as an adjusting portion, a medium between the two adjusting portions of each of the at least one pair of first signal terminals is completely a first medium, and a dielectric coefficient of the first medium is less than a dielectric coefficient of the insulating body.

2. The electrical connector according to claim 1, wherein:

the first side wall has a plurality of first separation walls, and each of the first separation walls continuously extends backward from a front thereof and passes backward beyond the bottom surface;

a row of the terminals are provided on the first side wall and comprise one pair of the first signal terminals and a first ground terminal provided adjacently along the first direction; and one of the first separation walls exists between the adjusting portion of the first ground terminal and the adjusting portion of an adjacent one of the first signal terminals, and none of the first separation walls exists between the adjusting portions of the one pair of the first signal terminals.

3. The electrical connector according to claim 2, wherein:

each of the first separation walls defines a first width in the first direction, a distance between the adjusting portions of the one pair of the first signal terminals in the first direction is defined as a first distance, a distance between the adjusting portion of the first ground terminal and the adjusting portion of the adjacent one of the first signal terminals in the first direction is defined as a second distance, the first distance is less than the first width, and the first width is less than the second distance;

a distance between the connecting portion of the first ground terminal and the connecting portion of the adjacent one of the first signal terminals is provided to be unequal backward from a front thereof and is separated by the one of the first separation walls, and a distance between the two connecting portions of the one pair of the first signal terminals is equal to the first distance backward from a front thereof and is not separated by any of the first separation walls.

4. The electrical connector according to claim 2, wherein:

a second direction is defined to be perpendicular to the first direction and the front-rear direction;

the side walls has a second side wall, the second side wall and the first side wall face each other along the second direction, the insertion slot is located between the first side wall and the second side wall, the second side wall has a plurality of second separation walls, each of the second separation walls continuously extends backward from a front thereof and passes backward beyond the bottom surface;

another row of the terminals are provided on the second side wall and comprise one pair of second signal terminals and a second ground terminal provided adjacently along the first direction; and one of the second separation walls exists between the adjusting portion of the second ground terminal and the adjusting portion of an adjacent one of the second signal terminals, and none of the second separation walls exists between the adjusting portions of the one pair of the second signal terminals.

5. The electrical connector according to claim 1, wherein:

the fixing portion of each of the terminals has a cushion portion connected forward to the adjusting portion;

the insulating block has a first hole, and the cushion portions of one pair of the first signal terminals are exposed in the first hole; and the insulating body has a first air slot, the first air slot is communicated with a side of the first hole, and the first air slot and the two cushion portions of the one pair of the first signal terminals pass through a same vertical plane.

6. The electrical connector according to claim 5, wherein two sides of the first hole in the first direction are provided to be outer relative to two sides of the first air slot in the first direction.

7. The electrical connector according to claim 1, wherein:

the terminals comprise one pair of the first signal terminals and a first ground terminal provided on the first side wall and provided adjacently along the first direction, the fixing portion of each of the terminals has a cushion portion connected forward to the adjusting portion;

the insulating block has a second hole, and the cushion portion of the first ground terminal is exposed in the second hole; and the insulating body has a second air slot, the second air slot is communicated with a side of the second hole, and the second air slot and the cushion portion of the first ground terminal pass through a same vertical plane.

8. The electrical connector according to claim 1, wherein:

the terminals further comprise at least one first ground terminal, one of the at least one pair of first signal terminals and the at least one first ground terminal are provided adjacently along the first direction and arranged in a row, and a size of each of the terminals along the first direction is defined as a width; and a width of the adjusting portion of each of the first signal terminals is greater than a width of the adjusting portion of the first ground terminal, and a width of the fixing portion of each of the first signal terminals is less than a width of the fixing portion of the first ground terminal.

9. The electrical connector according to claim 1, wherein each of two side edges of the contact portion of each of the terminals respectively has a guiding corner, and the guiding corners of one pair of the first signal terminals guide the contact portions to partially pass the corresponding first rib and to protrude into the insertion slot.

10. The electrical connector according to claim 1, wherein the first side wall has a plurality of first windows, each of the first windows penetrates through an outer surface of the first side wall, prior to the first component being inserted into the insertion slot, each of the first windows correspondingly exposes one pair of the contact portions of a corresponding pair of the first signal terminals and the corresponding first rib, and when the first component is inserted into the insertion slot, each of the first windows exposes outward a process of the one pair of the contact portions of the corresponding pair of the first signal terminals on both sides of the corresponding first rib moving outward.

11. An electrical connector, configured to electrically connect a first component and a second component, the electrical connector comprising:

an insulating body, having an insertion slot concavely provided backward and configured for the first component to insert backward therein along a front-rear direction, wherein a bottom surface is defined behind the insertion slot, the insulating body has a plurality of side walls surroundingly forming the insertion slot and connected to the bottom surface, one of the side walls is defined as a first side wall, the first side wall has a plurality of first separation walls, and each of the first separation walls continuously extends backward from a front thereof and passes backward beyond the bottom surface; and a plurality of terminals arranged in a row along a first direction, wherein the first direction is perpendicular to the front-rear direction, the row of the terminals are provided on the first side wall and have at least one pair of first signal terminals and at least one first ground terminal, at least one adjacent side of one of the at least one pair of first signal terminals is provided with one of the at least one first ground terminal, each of the terminals has an elastic portion extending along the front-rear direction and being free, a front end of the elastic portion is provided on the bottom surface close to front thereof and protrudes into the insertion slot to elastically abut and be electrically connected to the first component, a back end of the elastic portion has an adjusting portion, and the adjusting portion is provided to be behind relative to the bottom surface;

wherein one of the first separation walls is located between one of the first signal terminals and an adjacent one of the at least one first ground terminal, the one of the first separation walls continuously separates the two corresponding elastic portions thereof backward from a front thereof, none of the first separation walls exists between one of the at least one pair of first signal terminals, the two adjusting portions of the one of the at least one pair of first signal terminals are separated only by a first medium, and a dielectric coefficient of the first medium is less than a dielectric coefficient of each of the first separation walls;

wherein the first side wall has a first rib extending backward and having a free end, and the free end of the first rib is located between the one of the at least one pair of first signal terminals; and wherein the front end of the elastic portion of each of the first signal terminals has a contact portion arched toward the insertion slot, a portion of the contact portion protrudes inward into the insertion slot to elastically abut and be electrically connected to the first component, a back end of the contact portion has a transition portion, the transition portion is connected backward to a connecting portion, two opposite inner edges of two adjacent ones of the transition portions of the first signal terminals form a trumpet shape shrinking backward from a front thereof, and the first rib extends backward and does not pass beyond the transition portion.

12. The electrical connector according to claim 11, wherein each of two side edges of the contact portion of each of the first signal terminals respectively has a guiding corner, and the guiding corners of one pair of the first signal terminals guide the contact portions to partially pass the corresponding first rib and to protrude into the insertion slot.

13. The electrical connector according to claim 11, wherein:

an inward-outward direction is defined, a portion of the elastic portion protrudes inward into the insertion slot, and after abutting the first component, the elastic portion elastically deforms outward; and the first side wall has at least one window, one of the at least one window correspondingly exposes outward portions of a pair of the elastic portions of one of the at least one pair of first signal terminals.

14. The electrical connector according to claim 11, wherein:

each of the terminals has a fixing portion, and the fixing portion has a cushion portion connected forward to the adjusting portion;

the electrical connector further has an insulating block, the insulating block is provided behind the insertion slot, and the fixing portion is fixed to the insulating block;

an accommodating space and a protruding block are backward provided on a front surface of the insulating block, an inner side surface of the protruding block forms a side wall of the accommodating space, the cushion portion of each of the terminals is embedded in the protruding block, and the adjusting portion of each of the terminals extends forward from a front surface of the protruding block; and a back end of each of the first separation walls has a first portion extending backward into the accommodating space, each two adjacent ones of the first portions of the first separation walls and the inner side surface of the protruding block altogether form an air slot, inner sides of one of the at least one pair of first signal terminals are provided with one air slot, defined as a first air slot, an inner side of one of the at least one first ground terminal is provided with another air slot, defined as a second air slot, and a size of the first air slot in the first direction is greater than a size of the second air slot in the first direction.

15. The electrical connector according to claim 14, wherein the protruding block has a first hole concavely provided from the inner side surface of the protruding block, the first hole is communicated with the first air slot and exposes the cushion portions of one of the at least one pair of first signal terminals, and two sides of the first hole in the first direction are provided to be outer relative to two sides of the first air slot in the first direction.

16. The electrical connector according to claim 11, wherein each of the terminals has a fixing portion not freely provided, the elastic portion is formed by extending forward from the fixing portion, a size of each of the terminals along the first direction is defined as a width, a width of the adjusting portion of each of the first signal terminals is greater than a width of the adjusting portion of the adjacent first ground terminal, and a width of the fixing portion of each of the first signal terminals is less than a width of the fixing portion of the first ground terminal.

17. An electrical connector, configured to electrically connect a first component and a second component, the electrical connector comprising:

an insulating body, having an insertion slot concavely provided backward and configured for the first component to insert backward therein along a front-rear direction, wherein a bottom surface is defined behind the insertion slot, the insulating body has a plurality of side walls connected to the bottom surface, the side walls surroundingly form the insertion slot, one of the side walls is defined as a first side wall, the first side wall has a plurality of first ribs extending backward and a plurality of first separation walls extending backward, each of the first ribs has a free end located in front of the bottom surface, and each of the first separation walls continuously extends backward from a front thereof and passes backward beyond the bottom surface;

a plurality of terminals, comprising a plurality of pairs of first signal terminals and a plurality of first ground terminals arranged on the first side wall along a left-right direction, wherein each pair of the pairs of the first signal terminals is configured to transmit differential signals, each of a left side and a right side of each pair of the pairs of the first signal terminals is provided with an adjacent one of the first ground terminals, each of the terminals has a fixing portion, a contact portion provided in front of the fixing portion and a tail portion provided behind the fixing portion, the contact portion is provided relatively in front of the bottom surface and protrudes into the insertion slot to be electrically connected to the first component, and the tail portion is electrically connected to the second component; and at least one insulating block, installed in the insulating body, wherein the fixing portion of each of the first signal terminals and the fixing portion of each of the first ground terminals are respectively fixed to one of the at least one insulating block;

wherein one of the first separation walls exists between each of the first signal terminals and an adjacent one of the first ground terminals, and one of the first ribs exists between each pair of the pairs of first signal terminals.

18. The electrical connector according to claim 17, wherein:

an accommodating space and a protruding block are backward provided on a front surface of the insulating block, and an inner side surface of the protruding block forms a side wall of the accommodating space; and a back end of each of the first separation walls has a first portion extending backward into the accommodating space, each two adjacent ones of the first portions of the first separation walls and the inner side surface of the protruding block altogether form an air slot, inner sides of each pair of the pairs of first signal terminals are provided with one air slot, defined as a first air slot, an inner side of each of the first ground terminals is provided with another air slot, defined as a second air slot, and a size of the first air slot in the left-right direction is greater than a size of the second air slot in the left-right direction.

19. The electrical connector according to claim 18, wherein one side of the fixing portion of each of the terminals close to the contact portion has a cushion portion, the protruding block has a first hole concavely provided from the inner side surface of the protruding block, the first hole is communicated with the first air slot and exposes the cushion portions of one pair of the pairs of first signal terminals, and two sides of the first hole in the left-right direction are provided to be outer relative to two sides of the first air slot in the left-right direction.

20. The electrical connector according to claim 18, wherein:

the insulating body has an accommodating slot concavely provided forward from a rear thereof, the accommodating slot has a positioning plain surface located on a bottom portion thereof in a vertical direction, the side walls has a second side wall located below the first side wall, the first side wall and the second side wall face each other in the vertical direction, the insertion slot is located between the first side wall and the second side wall, the second side wall has a plurality of second separation walls and a plurality of second ribs, each of the second ribs has a free end portion located in front of the bottom surface, and each of the second separation walls continuously extends backward from a front thereof and passes backward beyond the bottom surface;

the terminals comprise a plurality of pairs of second signal terminals and a plurality of second ground terminals arranged on the second side wall along the first direction, each pair of the pairs of the second signal terminals is configured to transmit differential signals, each of two sides of each pair of the pairs of the first signal terminals is provided with an adjacent one of the second ground terminals, one of the second separation walls exists between each of the second signal terminals and the adjacent one of the second ground terminals, and one of the second ribs exists between each pair of the pairs of the second signal terminals; and the electrical connector comprises two insulating blocks, the fixing portion of each of the second signal terminals and the fixing portion of each of the second ground terminals are respectively fixed to another one of the two insulating blocks, and the two insulating blocks are accommodated in the accommodating slot and are both in contact with the positioning plain surface to perform positioning.

* * * * *